US008384629B2

(12) United States Patent
Shimoda

(10) Patent No.: US 8,384,629 B2
(45) Date of Patent: Feb. 26, 2013

(54) PIXEL DRIVE APPARATUS, LIGHT EMITTING APPARATUS, AND DRIVE CONTROL METHOD FOR THE LIGHT EMITTING APPARATUS

(75) Inventor: Satoru Shimoda, Tokyo (JP)

(73) Assignee: Casio Computer Co., Ltd., Tokyo (JP)

( * ) Notice: Subject to any disclaimer, the term of this patent is extended or adjusted under 35 U.S.C. 154(b) by 425 days.

(21) Appl. No.: 12/824,438

(22) Filed: Jun. 28, 2010

(65) Prior Publication Data

US 2010/0328297 A1 Dec. 30, 2010

(30) Foreign Application Priority Data

Jun. 29, 2009 (JP) ..... 2009-154164
Mar. 2, 2010 (JP) ..... 2010-045981

(51) Int. Cl.
*G09G 3/30* (2006.01)

(52) U.S. Cl. ..... 345/79; 345/76

(58) Field of Classification Search ..... None
See application file for complete search history.

(56) References Cited

U.S. PATENT DOCUMENTS 7,423,479 B2 9/2008 Higuchi
7,583,261 B2 9/2009 Shirasaki et al.
8,174,466 B2 * 5/2012 Toyomura et al. ..... 345/76
8,194,013 B2 * 6/2012 Choi ..... 345/78
2008/0030495 A1 * 2/2008 Shirasaki et al. ..... 345/214
2008/0122760 A1 * 5/2008 Levey et al. ..... 345/78

FOREIGN PATENT DOCUMENTS

JP 08-330600 A 12/1996
JP 2005-208127 A 8/2005
JP 2007-116493 A 5/2007
JP 2008-046157 A 2/2008
JP 2008-122848 A 5/2008

OTHER PUBLICATIONS

Japanese Office Action dated Aug. 2, 2011 (and English translation thereof) in counterpart Japanese Application No. 2010-045981.

* cited by examiner

*Primary Examiner* — Joseph Haley
(74) *Attorney, Agent, or Firm* — Holtz, Holtz, Goodman & Chick, PC

(57) ABSTRACT

An offset voltage generating circuit sets an offset voltage through binary search based on a voltage value of the initial voltage, and a voltage controlling circuit generates an output voltage which is a predetermined gradation voltage added with the offset voltage, and applies a voltage based on the output voltage to a control terminal of a drive transistor. A current comparison circuit applies a supply voltage from a power supply to the other end of current path of the drive transistor. The current comparison circuit compares the current value of a reference current corresponding to the gradation voltage with a current value of the current flowing in the current path of the drive transistor at this time. The offset voltage generating circuit acquires a specific offset voltage corresponding to variation of the characteristic of the drive transistor based on a result of comparison performed by the current comparison circuit.

16 Claims, 13 Drawing Sheets

PIXEL DRIVE APPARATUS, LIGHT EMITTING APPARATUS, AND DRIVE CONTROL METHOD FOR THE LIGHT EMITTING APPARATUS

CROSS-REFERENCE TO RELATED APPLICATION

This application claims the benefit of Japanese Patent Application No. 2009-154164 filed on Jun. 29, 2009 and Japanese Patent Application No. 2010-45981 filed on Mar. 2, 2010 the entire disclosure of which is incorporated by reference herein.

FIELD

The present invention relates to a pixel drive apparatus, a light emitting apparatus, and a drive control method for the light emitting apparatus.

BACKGROUND

An organic EL (Electro-Luminescent) device emits light with a DC voltage applied to a fluorescent organic compound. Light emitting apparatuses, display devices, etc. which have a matrix array of pixels each having this organic EL device are attracting attention as the next generation display devices.

This organic EL device is a current driven device that emits light with luminance which is proportional to the current flowing. An active matrix driven display device with such organic EL devices has pixels each provided with a drive transistor which is formed by a field effect transistor (thin film transistor) and controls the current value of the current supplied to the organic EL device.

A capacitor is connected between the gate and source of the drive transistor, and holds a voltage corresponding to the degree of gradation of image data externally supplied and written in the capacitor.

When a voltage is applied between the drain and source of the drive transistor, the drive transistor supplies the current to the organic EL device while controlling the current value with a gate-source voltage (hereinafter called "gate voltage") Vgs which is the voltage held in the capacitor. The organic EL device emits light with the luminance corresponding to the amount of the current supplied, so that the active matrix driven display device displays an image.

As a system of writing a voltage in a capacitor, there is a voltage writing system which applies a designated voltage between the gate and source of the drive transistor according to the degree of gradation of an image. Such a configuration is disclosed in, for example, Unexamined Japanese Patent Application KOKAI Publication No. H08-330600.

According to the voltage writing system, the current value of the current that flows to the organic EL device varies according to a time-dependent variation of the characteristic of the drive transistor. Even when the same voltage is applied between the gate and source of the drive transistor, therefore, the current value of the current flowing to the organic EL device changes, degrading the display quality.

As a solution to this shortcoming, there is a display device which applies a voltage, acquired by adding a gradation voltage and an offset voltage, to a data line, sequentially changes the offset voltage for a predetermined unit voltage, compares the current flowing to a power supply line with a reference current to acquire variation of the characteristic of the drive transistor, and corrects the voltage value of the voltage applied between the gate and source of the drive transistor based on the acquired variation of the characteristic of the drive transistor.

Because this display device sequentially changes the offset voltage for a predetermined unit voltage, however, it takes a relatively long time to acquire an offset voltage corresponding to the variation of the characteristic of the drive transistor. The normal display operation cannot be carried out during acquisition of the offset voltage, it is not possible to frequently acquire the offset voltage.

SUMMARY

Accordingly, it is an object of the present invention to provide a pixel drive apparatus capable of acquiring variation of the characteristic of a drive transistor in a short period of time, a light emitting apparatus equipped with the pixel drive apparatus, and a drive control method for the light emitting apparatus.

To obtain the aforementioned advantages, according to one aspect of the invention, there is provided a pixel drive apparatus for driving pixels each having a light emitting device and a drive transistor whose current path has one end connected to the light emitting device, the apparatus including:

a power supply configured to be connectable to an other end of the current path of the drive transistor and output a supply voltage;

an offset voltage generating circuit that generates an offset voltage;

a voltage controlling circuit that generates an output voltage which is a predetermined gradation voltage added with the offset voltage; and a current comparison circuit that compares a current value of a reference current corresponding to the gradation voltage with a current value of the current flowing in the current path of the drive transistor when the supply voltage is applied to the other end of the current path of the drive transistor and a voltage based on the output voltage is applied to a control terminal of the drive transistor, the offset voltage generating circuit setting a voltage value of the offset voltage through binary search based on a voltage value of an initial voltage, and acquiring a specific offset voltage corresponding to variation of a characteristic of the drive transistor based on a result of comparison performed by the current comparison circuit according to the offset voltage.

To obtain the aforementioned advantages, according to another aspect of the invention, there is provided a light emitting apparatus including:

at least one pixel having a light emitting device and a drive transistor whose current path has one end connected to the light emitting device;

at least one signal line connected to the pixel;

a power supply configured to be connectable to an other end of the current path of the drive transistor and output a supply voltage;

at least one offset voltage generating circuit provided in association with the signal line to generate an offset voltage;

at least one voltage controlling circuit provided in association with the signal line to generate an output voltage which is a predetermined gradation voltage added with the offset voltage; and at least one current comparison circuit that compares a current value of a reference current corresponding to the gradation voltage with a current value of the current flowing in the current path of the drive transistor when the supply voltage is applied to the other end of the current path of the drive transistor and a voltage based on the output voltage generated is applied to a control terminal of the drive transistor, the offset voltage generating circuit setting a voltage value of the offset voltage through binary search based on a voltage value of an initial voltage, and acquiring a specific offset voltage corresponding to variation of a characteristic of the drive transistor based on a result of comparison performed by the current comparison circuit according to the offset voltage.

To obtain the aforementioned advantages, according to a further aspect of the invention, there is provided a drive control method for a light emitting apparatus including at least one pixel having a light emitting device and a drive transistor whose current path has one end connected to the light emitting device, and at least one signal line connected to the pixel, the method including:

a gradation voltage generating step of generating a predetermined gradation voltage;

an offset voltage generating step of generating an offset voltage;

an output voltage generating step of generating an output voltage which is the gradation voltage added with the offset voltage;

an output voltage applying step of applying a voltage based on the output voltage to a control terminal of the drive transistor via the signal line;

a current comparison step of comparing a current value of a reference current corresponding to the gradation voltage with a current value of the current flowing in the current path of the drive transistor when a supply voltage is applied to the other end of the current path of the drive transistor and the voltage based on the output voltage is applied to the control terminal of the drive transistor; and a specific offset voltage acquiring step of acquiring a specific offset voltage corresponding to variation of a characteristic of the drive transistor based on a result of comparison performed in the current comparison step, the offset voltage generating step including a binary search step of setting a voltage value of the offset voltage through a binary search based on a voltage value of an initial voltage, wherein in the specific offset voltage acquiring step including, the specific offset voltage corresponding to the variation of the characteristic of the drive transistor is acquired based on the result of comparison performed in the current comparison step according to the offset voltage set in the binary search step.

BRIEF DESCRIPTION OF THE DRAWINGS

A more complete understanding of this application can be obtained when the following detailed description is considered in conjunction with the following drawings, in which.

DETAILED DESCRIPTION

A light emitting apparatus according to an embodiment of the present invention will be described below with reference to the accompanying drawings. It is to be noted that the light emitting apparatus in the following description of the embodiment is described as a display device equipped with a TFT-OLED (Thin Film Transistor-Organic Light-Emitting Diode) panel.

Figure 1:
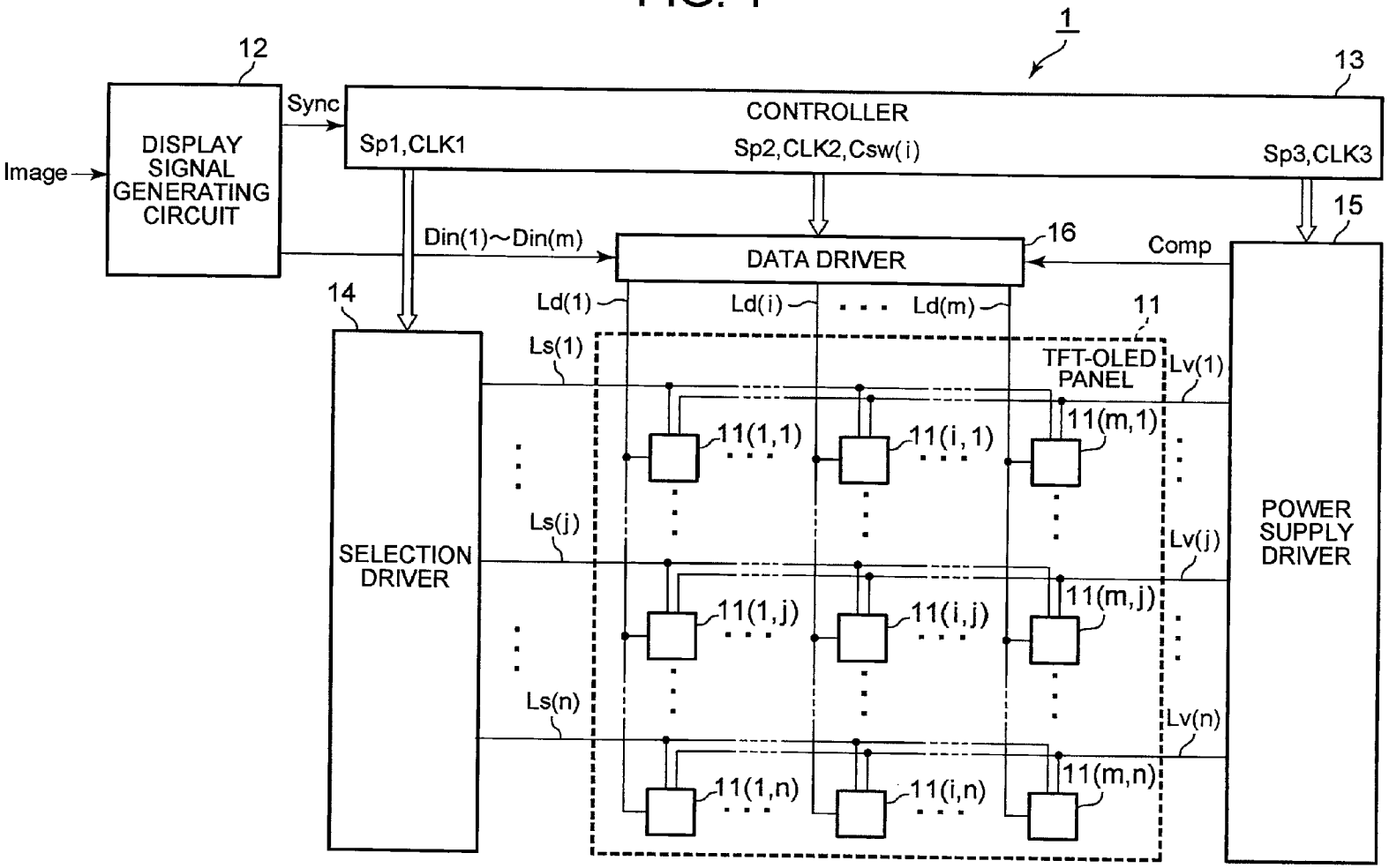
FIG. 1 is a block diagram showing the configuration of a display device according to an embodiment of the invention.

FIG. 1 shows the configuration of a display device 1 according to the embodiment.

The display device 1 according to the embodiment includes a TFT-OLED panel 11, a display signal generating circuit 12, a controller 13, a selection driver 14, a power supply driver 15, and a data driver 16.

The TFT-OLED panel 11 has a plurality of data lines (signal lines) Ld(i) (i=1 to m; natural number) provided to extend in the column direction, a plurality of scan lines Ls(j) (j=1 to n; natural number) provided to extend in the row direction, n power supply lines Lv(1) to Lv(n) provided to extend in the row direction along each scan line Ls(j), and a plurality of pixels 11(*i*,*j*) (i=1 to m, j=1 to n) provided near each intersection between each data line Ld(i) and each scan line Ls(j) and each power supply line Lv(j).

Figure 2:
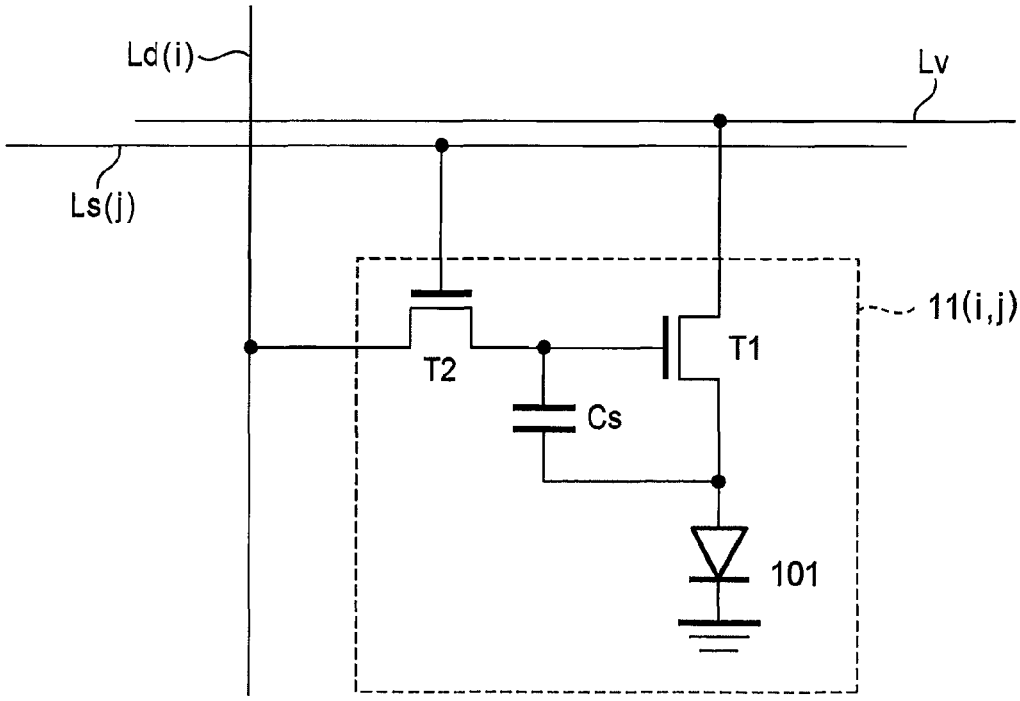
FIG. 2 is a circuit diagram showing the circuit configuration of each pixel shown in FIG. 1.

The pixels 11(*i*,*j*), each of which is a circuit corresponding to one pixel of a display image, are arranged in a matrix pattern. Each pixel 11(*i*,*j*) in the embodiment, which has a circuit configuration as shown in FIG. 2, includes an Organic EL device 101, transistors T1 and T2, and a capacitor Cs.

The organic EL device 101 is a light emitting device which emits light with a luminance corresponding to the amount of the current supplied, and is configured to have the lamination of a pixel electrode, an organic EL layer having a plurality of carrier transportation layers, and an opposing electrode. The opposing electrode (cathode electrode) is set to the ground potential.

The transistor T1, T2 is a thin film transistor (TFT) formed by an n-channel FET (Field Effect Transistor). Each of those thin film transistors is configured so that a semiconductor layer which forms a current path is formed of single amorphous silicon or contains amorphous silicon.

The transistor T1 is a drive transistor which controls the current value of the current to be supplied to organic EL device 101. The transistor T1 has a gate as a control terminal connected to the source of the transistor T2 and one end of the capacitor Cs, a source as one end of the current path connected to the other end of the capacitor Cs and the anode of the organic EL device 101, and a drain as the other end of the current path connected to the power supply line Lv(j).

The transistor T2 is a switch transistor whose gate serving as a control terminal is applied with a select signal or scan line signal Vscan(j) to connect or disconnect the data line Ld(i) to or from the gate of the transistor T1.

In the pixel 11(*i*,*j*), the transistor T2 has a source connected to the gate of the transistor T1 and one end of the capacitor Cs, and a drain connected to the data line Ld(i). The gate of each transistor T2 of the pixels 11(1,*j*), . . . , 11(*m*,*j*) is connected to the scan line Ls(j).

When a High-level signal is output to the scan line Ls(1), . . . , Ls(n), each transistor T2 is turned on to connect the gate of the transistor T1 to the data line Ld(1), . . . , Ld(m).

When a Low-level signal is output to the scan line Ls(1), . . . , Ls(n), each transistor T2 is turned off to disconnect the gate of the transistor T1 from the data line Ld(1), . . . , Ld(m).

The capacitor Cs is connected between the gate and source of the transistor T1. When the transistor T2 is turned off, the capacitor Cs holds the gate voltage Vgs of the transistor T1.

Returning to FIG. 1, the display signal generating circuit 12 acquires digital data as a display signal indicative of the degree of gradation of each pixel, and a sync signal Sync from, for example, a video signal Image, such as a composite video signal or component video signal, supplied externally.

The display signal generating circuit 12 supplies the sync signal Sync acquired from the video signal Image to the controller 13. The display signal generating circuit 12 supplies digital data (display signal) for each row corresponding to the degree of gradation of each pixel acquired from the video signal Image, as Din(1) to Din(m), to the data driver 16 for each row.

The controller 13 controls the write process and the light emission operation of the organic EL device 101. To execute such control, the controller 13 generates various control signals, such as clock signals CLK1, CLK2, CLK3, start signals Sp1, Sp2, Sp3, and a switch control signal Csw(i), which are synchronized with the sync signal Sync supplied from the display signal generating circuit 12.

The start signals Sp1, Sp2, Sp3 serve to initiate the operations of the individual components. The controller 13 supplies the start signals Sp1, Sp2, Sp3 and the clock signals CLK1, CLK2, CLK3 to the selection driver 14, the power supply driver 15, and the data driver 16, respectively.

The controller 13 supplies the switch control signal Csw(i) to the data driver 16. The switch control signal Csw(i) serves to set on or off an output switch Sw2(*i*), incorporated in the data driver 16.

The controller 13 supplies an ON-level (e.g., High-level) switch control signal Csw(i) to the data driver 16 when setting on (closing) the output switch Sw2(*i*), and supplies an OFF-level (e.g., Low-level) switch control signal Csw(i) to the data driver 16 when setting off (opening) the output switch Sw2(*i*).

The selection driver 14 selects the pixels 11(1,*j*) to 11(*m*,*j*) of the jth row (j=1 to n). The selection driver 14 has a shift register (not shown) to sequentially shift the High-level start signal Sp1, supplied from the controller 13, according to the clock signal CLK1, and sequentially outputs select signals Vscan(1) to Vscan(n) with a shifted ON level (hereinafter called as "Vscan ON level"; the Vscan ON level is a High level, for example) to the scan lines Ls(1), . . . , Ls(n). As a result, the pixels 11(1,1) to 11(*m*,1) of the first row, . . . , the pixels 11(1,*n*) to 11(*m*,*n*) of the nth row are selected sequentially.

The power supply driver 15 supplies a supply voltage to the power supply line Lv(j) (j=1 to n). The power supply driver 15 starts operating in response to the start signal SP3 supplied from the controller 13, and operates in synchronization with the clock signal CLK3.

Figure 3:
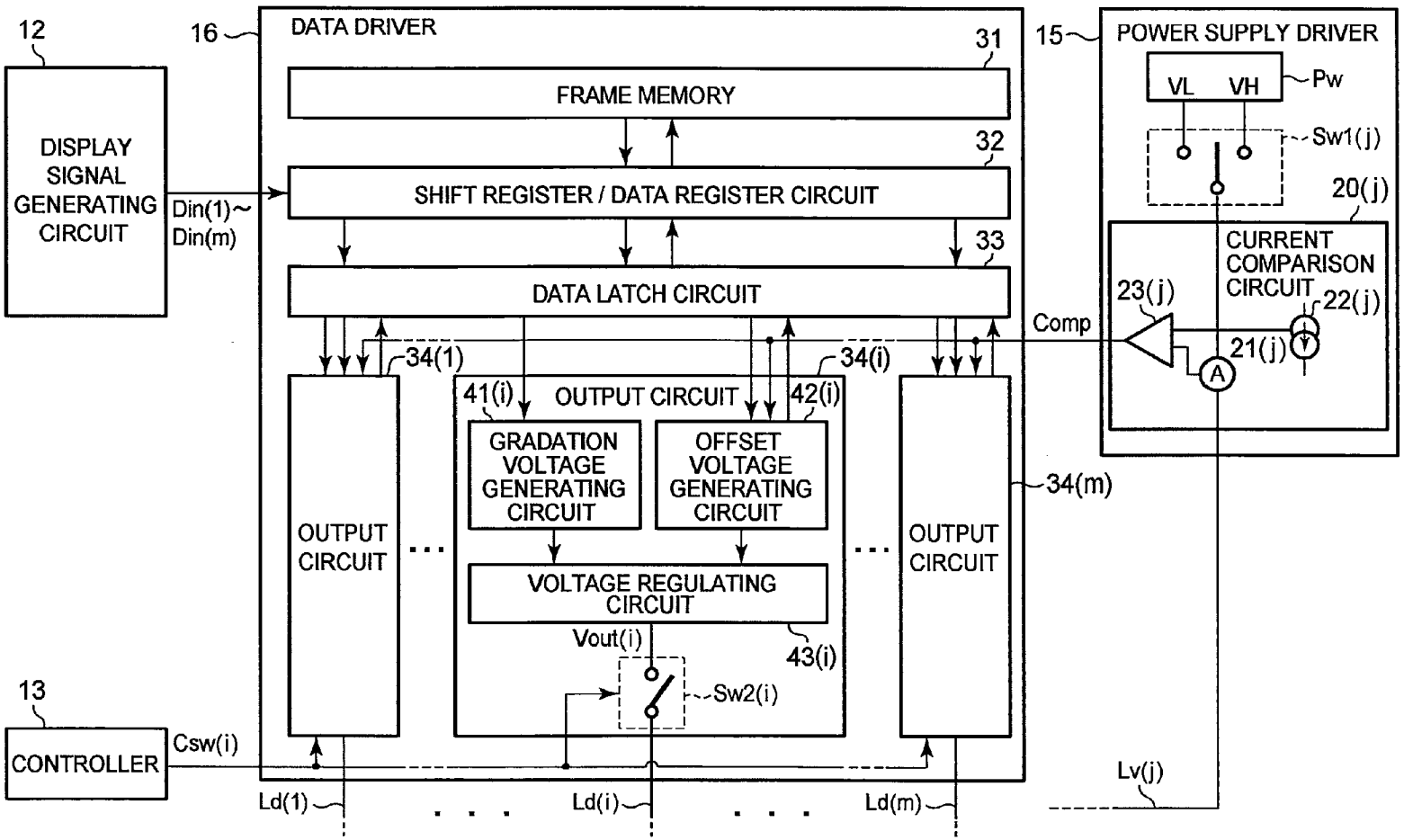
FIG. 3 is a diagram showing the configurations of a data driver and a power supply driver shown in FIG. 1.

As shown in FIG. 3, the power supply driver 15 has a power supply circuit Pw which outputs a voltage VH and a voltage VL, and switches Sw1(*j*) and current comparison circuits 20(*j*), which are provided in association with the respective power supply lines Lv(j) (j=1 to n).

The switch Sw1(*j*) serves to apply either the voltage VH or the voltage VL output from the power supply circuit Pw to the power supply line Lv(j). The power supply driver 15 controls the changeover of the switch Sw1(*j*).

The voltage VH is a High-level (positive) voltage which enables the organic EL device 101 of each pixel 11(*i*,*j*) to emit light, and is set to, for example, +15 V. The voltage VL is a Low-level voltage lower than the voltage VH, and is set to, for example, the cathode potential (ground potential) of the organic EL device 101.

The current comparison circuit 20(*j*) compares the current value of a reference current Iref with the current value of a power supply current ILv as the power supply current that flows through the power supply line Lv(j). The current comparison circuit 20(*j*) is used when an offset voltage generating circuit 42(*i*) acquires an offset voltage corresponding to variation of the characteristic, such as a threshold voltage Vth, of the transistor T1 of each pixel 11(*i*,*j*).

The following describes a method of acquiring an offset voltage corresponding to variation of the characteristic.

The drain current (value), Id, of the transistor T1 is expressed by the following equation 11.

$$Id=\beta(Vgs-Vth)^2 \tag{11}$$

where β is a constant, Vgs is the gate-source voltage (hereinafter called "gate voltage") of the transistor T1, and Vth is the threshold voltage of the transistor T1 at which the drain current Id flows. The threshold voltage Vth is shifted by time-dependent degradation or the like.

As mentioned above, in response to the drain current Id supplied, the organic EL device 101 emits light with a luminance corresponding to the current value of the drain current Id. As shown in the equation 11, adding the threshold voltage Vth to the gate voltage Vgs cancels out the threshold voltage Vth, so that the organic EL device 101 can caused to emit light with a luminance corresponding to digital data Din(i).

Let Vdata0 be an original gradation voltage corresponding to digital data Din(1) to Din(m), and let the current value of the drain current Id flowing between the drain and source of the transistor T1, for example, when the original gradation voltage Vdata0 is applied to the gate of the transistor T1 which has the initial characteristic be the current value of the reference current Iref. After the time-dependent degradation of the transistor T1 occurs, a voltage which is the original gradation voltage Vdata0 added with a predetermined offset voltage Voffset is applied to the gate of the transistor T1. At this time, when the current value of the drain current Id which flows between the drain and source of the transistor T1 is equal to the current value of the reference current Iref or a current value closed thereto, the offset voltage Voffset is a voltage equivalent to a change in the threshold voltage Vth of the transistor T1.

In the above, the current value of the reference current Iref is the measured value of the drain current Id flowing when the original gradation voltage Vdata0 is applied to the gate of the transistor T1 which has the initial characteristic. In another example, the current value of the reference current Iref may be the designed value of the drain current Id which is predicted to flow when the original gradation voltage Vdata0 is applied to the gate of the transistor T1.

Therefore, the offset voltage Voffset can be varied by setting an output voltage Vout to be applied to the data line Ld(i)

to a voltage value obtained by adding the offset voltage Voffset to the original gradation voltage Vdata0, as indicated by an equation 12 below. Accordingly, the offset voltage Voffset when the current value of the power supply current ILv flowing through the power supply line Lv(j) becomes a value closest to the current value of the reference current Iref becomes a voltage equivalent to a change in the threshold voltage Vth of the transistor T1.

$$Vout=Vdata0+Voffset \quad (12)$$

According to the embodiment, given that the reference current Iref is set to the current that corresponds to the preset original gradation voltage Vdata0, and the output voltage Vout(i) corresponding to the ith column is applied to the data line Ld(i), the current value of the power supply current ILv flowing through the power supply line Lv(j) is compared with the current value of the reference current Iref. Based on the result of the comparison, the offset voltage Voffset equivalent to a change in the threshold voltage Vth of the transistor T1 is acquired.

The current comparison circuit 20(*j*) has a ammeter 21(*j*), a constant current source 22(*j*) which supplies the reference current Iref, and a comparator 23(*j*). The current comparison circuit 20(*j*) compares the current value of the reference current Iref with the current value of the power supply current ILv flowing through the power supply line Lv(j) when the output voltage Vout(i) is applied to the data line Ld(i).

The ammeter 21(*j*) measures the power supply current ILv flowing through the power supply line Lv(j). The constant current source 22(*j*) supplies the reference current Iref.

The comparator 23(*j*) compares the reference current Iref with the power supply current ILv, and outputs the comparison result (Comp). When the comparator 23(*j*) is configured to compares two input voltages with each other, the ammeter 21(*j*) supplies a voltage equivalent to the current value of the power supply current ILv measured to the comparator 23(*j*).

The comparator 23(*j*) outputs a comparison result Comp="1" when the power supply current ILv is larger than or equal to the reference current Iref, and outputs a comparison result Comp="0" when the power supply current ILv is smaller than the reference current Iref.

Although in the current comparison circuit 20(*j*) has the constant current source 22(*j*) which supplies the reference current Iref in FIG. 3, the current comparison circuit 20(*j*) may have a voltage source which supplies a voltage equivalent to the current value of the reference current Iref to the comparator 23(*j*), instead of the constant current source 22(*j*), when the comparator 23(*j*) is configured to compares two input voltages with each other.

The data driver 16 shown in FIG. 1 writes charges in the capacitors Cs of the individual pixels 11(1,*j*) to 11(*m*,*j*) of the selected jth row by applying the output voltages Vout(1) to Vout(m) to the data lines Ld(1) to Ld(m), respectively.

The data driver 16 includes a frame memory 31, a shift register/data register circuit 32, a data latch circuit 33, and output circuits 34(1) to 34(*m*), as shown in FIG. 3.

The frame memory 31 stores a specific offset value Doffset_s(i,j) of the transistor T1 of each pixel 11(*i*,*j*). The shift register/data register circuit 32 sequentially shifts and fetches one row of digital data Din(1) to Din(m) of the jth row for each pixel supplied from the display signal generating circuit 12. The shift register/data register circuit 32 supplies the fetched digital data Din(1) to Din(m) to the data latch circuit 33.

The data latch circuit 33 holds the digital data Din(1) to Din(m) supplied from the shift register/data register circuit 32. The data latch circuit 33 then supplies the held digital data Din(1) to Din(m) to the output circuit 34(*i*).

The output circuit 34(*i*) (i=i to m) generates the output voltage Vout(i) of the ith column in the jth row according to the equation 12, and applies the generated output voltage Vout(i) to the data line Ld(i). As a result, a charge corresponding to the gate voltage Vgs of the transistor T1 is written in the capacitor Cs of each pixel 11(*i*,*j*). The output circuit 34(*i*) includes a gradation voltage generating circuit 41(*i*), the offset voltage generating circuit 42(*i*), a voltage controlling circuit 43(*i*) and the output switch Sw2(*i*).

The gradation voltage generating circuit 41(*i*) generates an analog original gradation voltage Vdata0(*i*) corresponding to digital data Din(i) supplied from the data latch circuit 33. The offset voltage generating circuit 42(*i*) generates an offset voltage Voffset(i,j) corresponding to each pixel 11(*i*,*j*). The offset voltage generating circuit 42(*i*) acquires the specific offset value Doffset_s(i,j) corresponding to each pixel 11(*i*,*j*), which is stored in the frame memory 31, and generates an offset voltage Voffset(i,j) corresponding to the acquired specific offset value Doffset_s(i,j). Then, the offset voltage generating circuit 42(*i*) supplies the generated offset voltage Voffset(i,j) to the voltage controlling circuit 43(*i*). In addition, the offset voltage generating circuit 42(*i*) acquires a specific offset voltage Voffset_s(i,j) corresponding to a change in the threshold voltage Vth.

The voltage controlling circuit 43(*i*) adds the original gradation voltage Vdata0(*i*) generated by the gradation voltage generating circuit 41(*i*), and the offset voltage Voffset(i,j) generated by the offset voltage generating circuit 42(*i*) to generate an output voltage Vout(i). The output voltage Vout(i) generated by the voltage controlling circuit 43(*i*) is applied to the data line Ld(i) when the output switch Sw2(*i*) is closed.

The embodiment is characterized in that the offset voltage generating circuit 42(*i*) is configured to use binary search to acquire the offset voltage Voffset(i,j) corresponding to a change in the threshold voltage Vth in a short period of time.

Specifically, the output circuit 34(*i*) applies the output voltage Vout(i) to the data line Ld(i), and the comparator 23(*j*) of the current comparison circuit 20(*j*) compares the power supply current ILv flowing through the power supply line Lv(j) with the reference current Iref.

Then, the output circuit 34(*i*) repeatedly performs the following equations 13 and 14 until the following condition 11 is fulfilled. Then, the offset voltage generating circuit 42(*i*) acquires the offset voltage Voffset(i,j) when the following condition 11 is fulfilled, as the specific offset voltage Voffset_s(i,j) corresponding to a change in the threshold voltage Vth. In the following description, (i,j) in the offset voltage Voffset(i,j) will be omitted as needed.

That is, when the power supply current (value) ILv when the offset voltage is Voffset[p] is equal to or greater than the reference current (value) Iref, and when the power supply current (value) ILv when the offset voltage Voffset[p] is decreased by one bit which is the minimum resolution of the Voffset[p] is equal to or smaller than the reference current (value) Iref, the offset voltage Voffset[p] is acquired as the aforementioned specific offset voltage Voffset_s.

$$ILv(Voffset[p]) \geqq Iref \quad \text{and} \quad ILv(Voffset[p]-Voffset\ LSB) \leqq Iref \quad \text{<Condition 11>}$$

$$Voffset[1]=Voffset_max/2$$

If $ILv(Voffset[p])<Iref$, $$Voffset[p]=Voffset[p-1]+Voffset_max/2^{p} \quad (13)$$

If $ILv(Voffset[p])>Iref$, $$Voffset[p]=Voffset[p-1]-Voffset_max/2^{p} \quad (14)$$

where

Voffset[1]: voltage value of the first offset voltage Voffset through binary search Voffset_max: maximum value (initial voltage) of the offset voltage p: count value for binary search Voffset[p]: voltage value of the pth offset voltage Voffset through binary search Voffset[p−1]: voltage value of the (p−1)th offset voltage Voffset through binary search ILv(Voffset[p]): current value of the power supply current flowing through the power supply line Lv(j) when the output voltage Vout=Vdata0+Voffset[p] is applied to the data line Ld(i)

VoffsetLSB: voltage value corresponding to the least significant bit of the offset voltage Voffset There are a case where the maximum value Voffset_max of the offset voltage, the offset voltage Voffset[1], Voffset[p], Voffset[p−1] at the time of binary search have a positive polarity and a case where they have a negative polarity, according to the circuit configuration of each pixel 11(*i*,*j*). When each pixel 11(*i*,*j*) has the circuit configuration shown in FIG. 2, for example, those values have a positive polarity, and when each pixel 11(*i*,*j*) has a circuit configuration shown in FIG. 12 to be discussed later, those values have a negative polarity. It is to be noted that an absolute value is used as the value of each voltage. In addition, absolute values are also used as the current value ILv(Voffset[p]) of the power supply current and the value of the reference current Iref.

When the comparison result Comp="1" is supplied from the comparator 23(*j*) of the current comparison circuit 20(*j*), the offset voltage generating circuit 42(*i*) judges that ILv (Voffset[p])<Iref, and performs the equation 13.

When the comparison result Comp="0" is supplied, the offset voltage generating circuit 42(*i*) judges that ILv(Voffset [p])>Iref, and performs the equation 14.

The offset voltage generating circuit 42(*i*) has an offset register which temporarily stores, for example, a digital offset value Doffset(i,j) corresponding to an offset voltage Voffset [p](i,j), and executes an operation of acquiring the aforementioned specific offset voltage Voffset_s(i,j) while adequately updating the value of the offset value Doffset(i,j) to be stored in the offset register. The offset value Doffset(i,j) has, for example, a bit number of 8 bits.

The output circuit 34(*i*) supplies the digital specific offset value Doffset_s(1,*j*) corresponding to the acquired specific offset voltage Voffset_s(i,j) to the frame memory 31. The frame memory 31 stores the supplied specific offset value Doffset_s(1,*j*).

The output switch Sw2(*i*), which controls the outputting of the output voltage Vout(i) of the output circuit 34(*i*), is set on or off according to the switch control signal Csw(i) supplied from the controller 13.

When the ON-level switch control signal Csw(i) is supplied from the controller 13, the output switch Sw2(*i*) is closed to connect the voltage controlling circuit 43(*i*) to the data line Ld(i). When the OFF-level switch control signal Csw(i) is supplied from the controller 13, on the other hand, the output switch Sw2(*i*) is opened to disconnect the voltage controlling circuit 43(*i*) from the data line Ld(i).

<Light Emission Operation>

Next, a description will be given of the light emission operation of the display device 1 according to the embodiment to cause the organic EL device of each pixel to emit light with a luminance corresponding to a video signal supplied externally.

Figure 4:
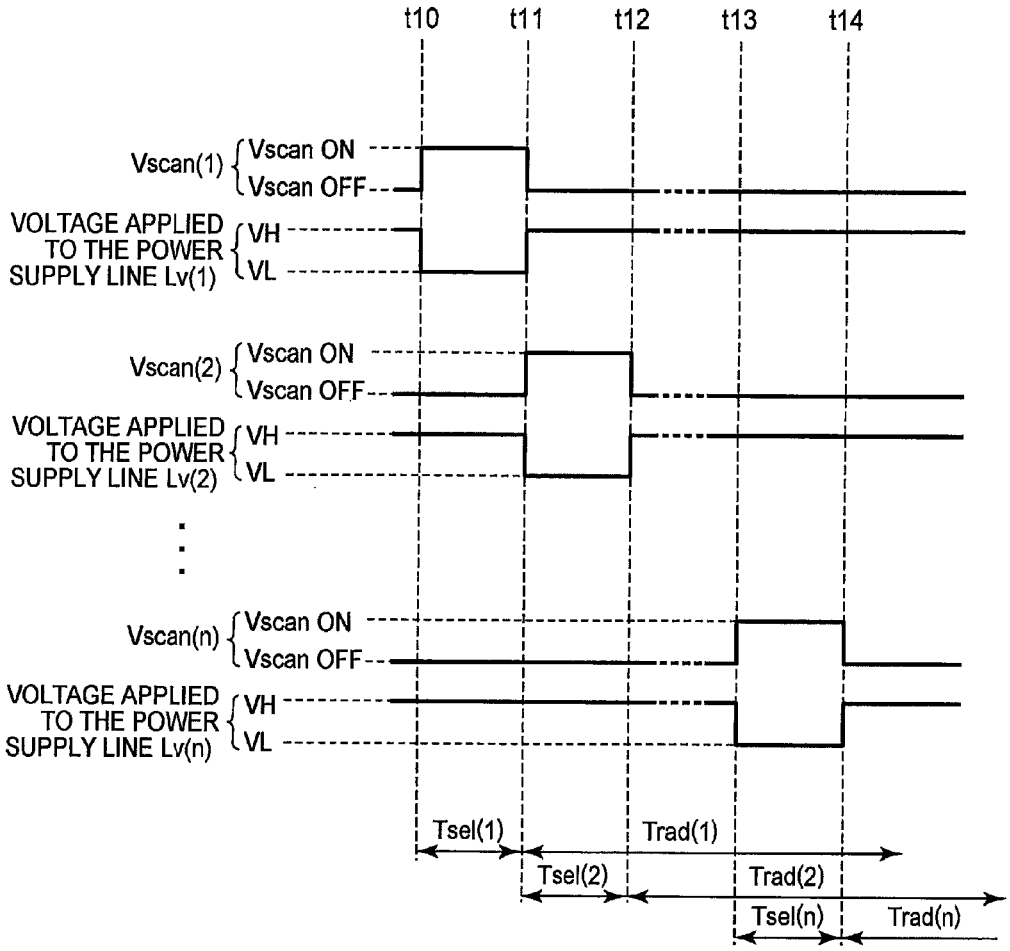
FIG. 4 is a timing chart when each pixel of the display device shown in FIG. 1 is operated to emit light.
Figure 5:
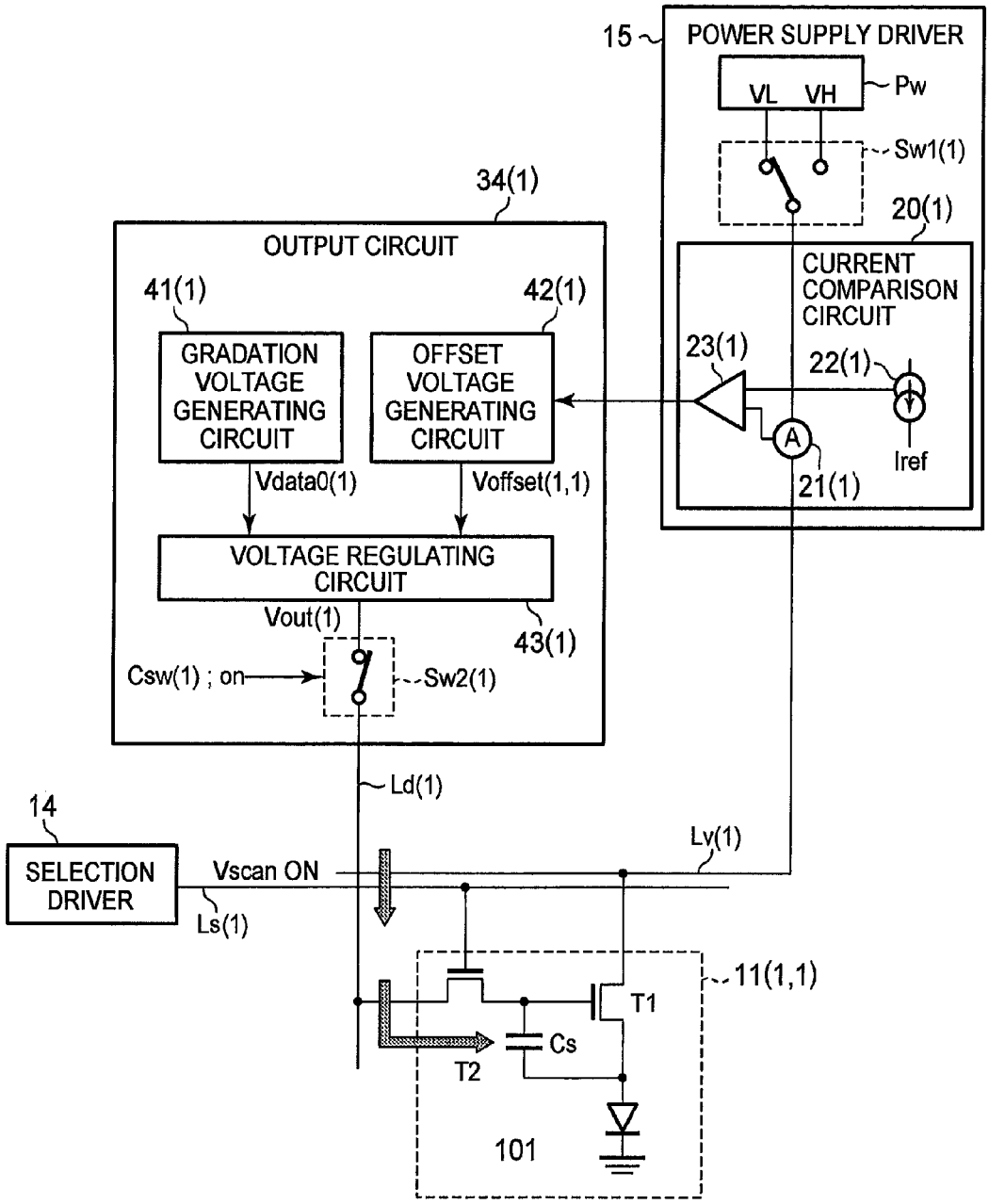
FIG. 5 is a diagram showing an operation in a selection period shown in FIG. 4.
Figure 6:
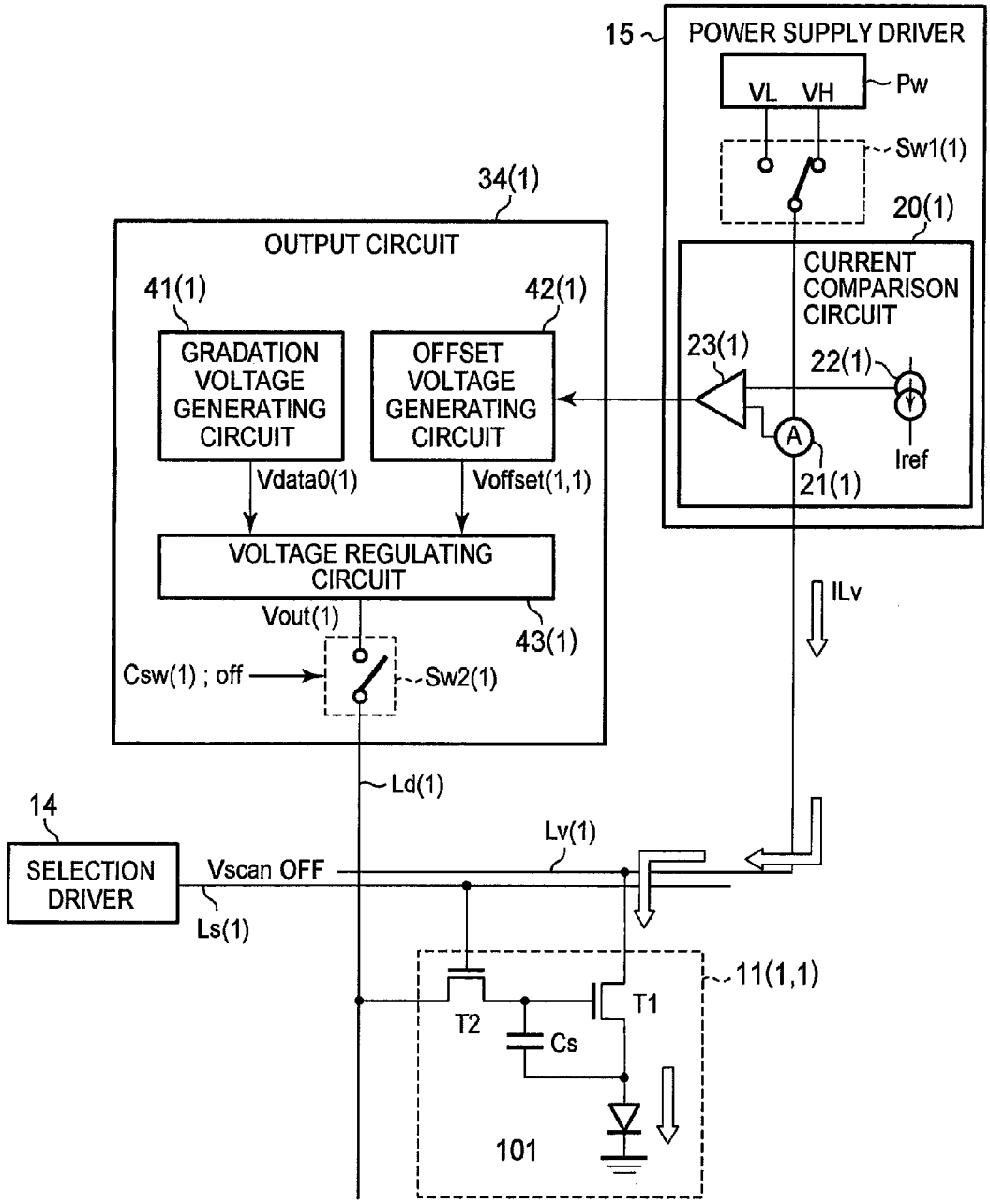
FIG. 6 is a diagram showing an operation in a light emission period shown in FIG. 4.

FIG. 4 is a timing chart when each pixel of the display device 1 is operated to emit light. FIG. 5 is a diagram showing the operation in a selection period when the pixel 11(1,1) is operated to emit light. FIG. 6 is a diagram showing the operation in a light emission period when the pixel 11(1,1) is operated to emit light.

When the video signal Image is supplied externally, the display signal generating circuit 12 generates digital data Din(1) to Din(m) as a display signal indicating the degree of gradation of each pixel according to the supplied video signal Image, and the sync signal Sync. Then, the display signal generating circuit 12 supplies the generated digital data Din (1) to Din(m) to the data driver 16, and supplies the sync signal Sync to the controller 13.

The controller 13 generates various control signals, such as the clock signals CLK1, CLK2, CLK3, and start signals Sp1, Sp2, Sp3, which are synchronous with the sync signal Sync supplied from the display signal generating circuit 12, and supplies the start signals Sp1, Sp2, Sp3 and the clock signals CLK1, CLK2, CLK3 to the selection driver 14, the power supply driver 15 and the data driver 16, respectively.

As shown in FIG. 4, at time t10, the controller 13 supplies the start signals Sp1, Sp2, Sp3 and the clock signals CLK1, CLK2, CLK3 to the selection driver 14, the power supply driver 15 and the data driver 16, respectively. The selection driver 14, the power supply driver 15 and the data driver 16 start operating in response to the start signals Sp1, Sp2, Sp3 supplied from the controller 13, respectively, and operate in synchronization with the clock signals CLK1, CLK2, CLK3, respectively.

At time t10, the selection driver 14 outputs the select signal Vscan(1) with the Vscan ON level to the scan line Ls(1), and outputs scan line signals Vscan(2) to Vscan(n) with an OFF level (hereinafter called "Vscan OFF level"; the Vscan OFF level is a Low level, for example) to the scan lines Ls(2) to Ls(n), respectively.

As shown in FIG. 5, each transistor T2 of the pixels 11(1,1) to 11(*m*,1) of the first row is turned on in response to the select signal Vscan(1) with the Vscan ON level via the scan line Ls(1) supplied to the gate thereof.

The power supply driver 15 changes over the switch Sw1 (1) to the Low-level voltage VL side to apply the voltage VL to the power supply line Lv(j) via the switch Sw1(1).

Meanwhile, the display signal generating circuit 12 supplies digital data Din(1) to Din(m) of the first row to the data driver 16. The shift register/data register circuit 32 sequentially shifts and fetches the digital data Din(1) to Din(m). The display signal generating circuit 12 then supplies the fetched digital data Din(1) to Din(m) to the data latch circuit 33.

The data latch circuit 33 holds the supplied digital data Din(1) to Din(m). The data latch circuit 33 then supplies the held digital data Din(1) to Din(m) to the output circuits 34(1) to 34(*m*).

The gradation voltage generating circuit 41(1) generates an analog original gradation voltage Vdata0(1) corresponding to the digital data Din(1) supplied from the data latch circuit 33. The gradation voltage generating circuit 41(1) then supplies the generated original gradation voltage Vdata0(1) to the voltage controlling circuit 43(1).

The offset voltage generating circuit 42(1) acquires a specific offset value Doffset_s(1,1) corresponding from the frame memory 31, and generates a specific offset voltage Voffset_s(1,1), which is an analog signal and corresponds to the acquired specific offset value Doffset_s(1,1). The offset voltage generating circuit 42(1) then supplies the generated specific offset voltage Voffset_s(1,1) to the voltage controlling circuit 43(1). The voltage controlling circuit 43(1) adds the original gradation voltage Vdata0(1) supplied from the gradation voltage generating circuit 41(1) and the specific offset voltage Voffset_s(1,1) supplied from the offset voltage generating circuit 42(1) according to the equation 12, thereby generating the output voltage Vout(1). The voltage controlling circuit 43(1) may add the digital data Din(1) and the specific offset value Doffset_s(1,*j*), and may generate an analog output voltage Vout(1) corresponding to the added digital value.

In the output circuits 34(2) to 34(*m*), the voltage controlling circuits 43(2) to 43(*m*) likewise generate output voltages Vout(2) to Vout(m), respectively.

The controller 13 supplies an ON-level switch control signal Csw(1) and OFF-level switch control signals Csw(2) to Csw(n) to the data driver 16.

The output switch Sw2(1) is closed when the ON-level switch control signal Csw(1) is supplied from the controller 13, and the output switches Sw2(2) to Sw2(*n*) is opened when the OFF-level switch control signals Csw(2) to Csw(n) are supplied from the controller 13.

When the output switch Sw2(1) is closed, as shown in FIG. 5, the output voltage Vout(1) generated by the voltage controlling circuit 43(1) is applied to the data line Ld(i). As a result, the output voltage Vout(1) is applied to the gate of the transistor T1 and the capacitor Cs via the data line Ld(1) and the drain and source of the transistor T2 of the pixel 11(1,1).

The Low-level voltage VL is applied to the power supply line Lv(1) by the power supply driver 15 at this time, so that the current does not flow to the transistor T1 and the organic EL device 101.

The capacitor Cs of the pixel 11(1,1) is charged with the output voltage Vout(1) supplied from the data line Ld(1), so that a charge corresponding to the output voltage Vout(1) is stored in the capacitor Cs (i.e., the charge is written therein).

The controller 13 sequentially supplies the ON-level switch control signals Csw(2) to Csw(m) to the data driver 16. The output circuits 34(2) to 34(*m*) respectively apply the output voltages Vout(2) to Vout(m), generated by the voltage controlling circuits 43(2) to 43(*m*), to the data lines Ld(2) to Ld(m). As a result, charges corresponding to the output voltages Vout(2) to Vout(m) are written in the capacitors Cs of the pixels 11(2,1) to 11(*m*,1), respectively.

In FIG. 4, at time t11, the selection driver 14 outputs the scan line signal Vscan(1) with the Vscan OFF level to the scan line Ls(1), and the power driver 15 switches the switch Sw1 (1) to the voltage VH side, and applies a voltage VH with High level to the power supply line Lv (1).

As shown in FIG. 6, when the selection driver 14 outputs the scan line signal Vscan(1) with the Vscan OFF level to the scan line Ls(1), each transistor T2 of the pixels 11(1,1) to 11(*m*,1) is turned off to disable application of the output voltage Vout(1) to the gate of the transistor T1 of the pixel 11(1,1) and the capacitor Cs from the output circuit 34(1).

When the power supply driver 15 applies the High-level voltage VH to the power supply line Lv(1), as shown in FIG. 6, the power supply current ILv flows to the ground potential side via the power supply line Lv(1), the drain and source of the transistor T1 of the pixel 11(1,1), and the organic EL device 101.

The amount of the power supply current ILv is controlled by the gate voltage Vgs held in the capacitor Cs, so that the transistor T1 supplies the power supply current ILv whose amount corresponds to the gate voltage Vgs to the organic EL device 101.

Therefore, the organic EL devices 101 of the pixels 11(1,1) to 11(*m*,1) emit light with the luminance corresponding to the output voltage Vout(i)=Vdata0(*i*)+Voffset(i,1), i.e., the luminance corresponding to the video signal Image.

In FIG. 4, the time period t10 to t11 is a selection period Tsel(1) for the pixels 11(1,1) to 11(*m*,1) of the first row, and the time period at and following t11 is a light emission period Trad(1) for the pixels 11(1,1) to 11(*m*,1) of the first row.

Likewise, the time period t11 to t12 is a selection period Tsel(2) for the pixels 11(1,2) to 11(*m*,2) of the second row, and the time period at and following t12 is a light emission period Trad(2) for the pixels 11(1,2) to 11(*m*,2) of the second row.

Time period t13 to t14 is a selection period Tsel(n) for the pixels 11(1,*n*) to 11(*m*,*n*), and the time period at and following t14 is a light emission period Trad(n) for the pixels 11(1,*n*) to 11(*m*,*n*).

In each of the selection periods Tsel(2) to Tsel(n), a charge corresponding to the output voltage Vout(i) is written in each of the capacitors Cs of the pixels 11(1,2) to 11(*m*,2) of the second row to the capacitors Cs of the pixels 11(1,*n*) to 11(*m*,*n*) of the nth row.

Then, in each of the selection periods Tsel(2) to Tsel(n), the organic EL devices 101 of the pixels 11(1,2) to 11(*m*,2) of the second row to the organic EL devices 101 of the pixels 11(1,*n*) to 11(*m*,*n*) of the nth row emit light with the luminance corresponding to the video signal Image.

<Specific Offset Voltage Acquiring Process>

Next, a detailed description will be given of a specific offset voltage acquiring process for acquiring an offset voltage for each pixel in the display device 1 according to the embodiment.

Figure 7:
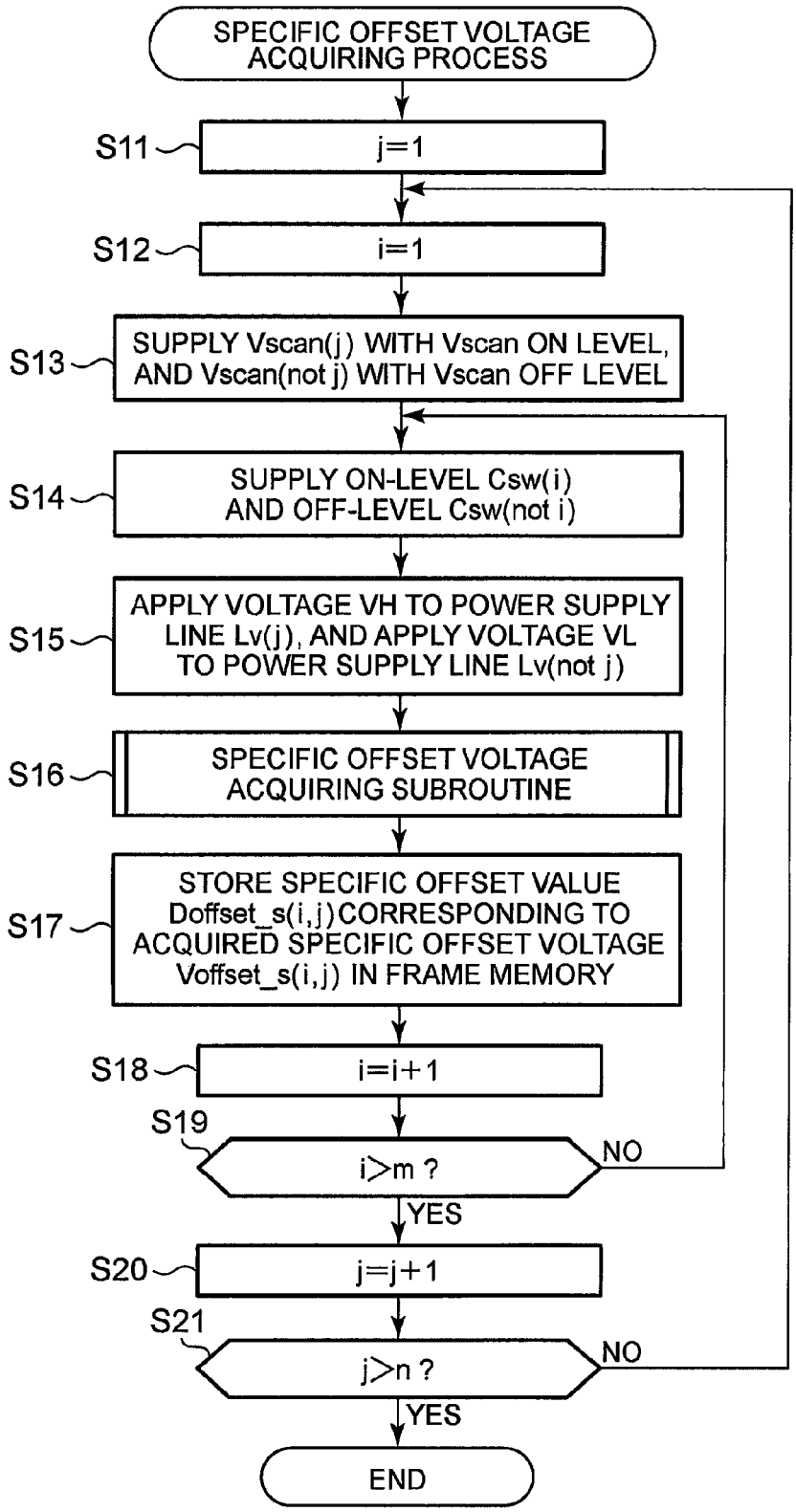
FIG. 7 is a flowchart of a specific offset voltage acquiring process which is executed by the display device shown in FIG. 1.
Figure 8:
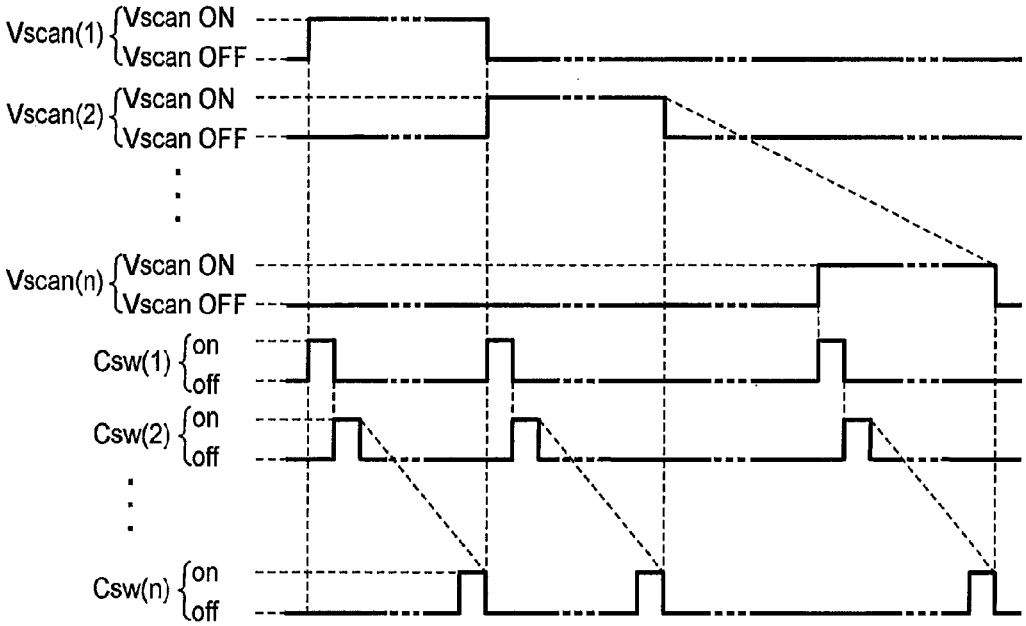
FIG. 8 is a timing chart when the display device shown in FIG. 1 executes the specific offset voltage acquiring process.

FIG. 7 is a flowchart of the specific offset voltage acquiring process which is executed by the display device 1, and FIG. 8 is a timing chart when the display device 1 executes the specific offset voltage acquiring process.

The display device 1 executes the specific offset voltage acquiring process according to the flowchart as illustrated in FIG. 7, for example, at the time of activation or at a regular timing, or at an adequate timing in a standby mode or the like to acquire specific offset voltages Voffset_s(1,1) to Voffset_s (m,1) for the pixels 11(1,1) to 11(*m*,1) of the first row to specific offset voltages Voffset_s(1,*n*) to Voffset_s(m,n) for the pixels 11(1,*n*) to 11(*m*,*n*) of the nth row.

In the specific offset voltage acquiring process, first, the display device 1 sets "1" to j (variable) (step S11), and sets "1" to i (variable) (step S12).

Next, as shown in FIGS. 7 and 8, the selection driver 14 outputs the select signal Vscan(j) with the Vscan ON level to the jth scan line Ls(j). Then, the selection driver 14 supplies scan line signals Vscan(not j) with the Vscan OFF level to the scan lines Ls(not j) of other rows than the jth row (referred to as "not j") (step S13).

As shown in FIGS. 7 and 8, the controller 13 supplies the ON-level switch control signal Csw(i) to the data line Ld(i) of the ith column. Then, OFF-level switch control signals Csw (not i) are supplied to the data lines Ld(not i) of other columns than the ith column (referred to as "not i") (step S14).

The power supply driver 15 changes over the switch Sw1(*j*) corresponding to the jth row to the voltage VH side to apply the voltage VH to the jth power supply line Lv(j). Then, the power supply driver 15 changes over the switches Sw1(not j) of other rows than the jth row (not j) to the voltage VL side to apply the voltage VL to the power supply lines Lv(not j) of other rows than the jth row (step S15).

Figure 9:
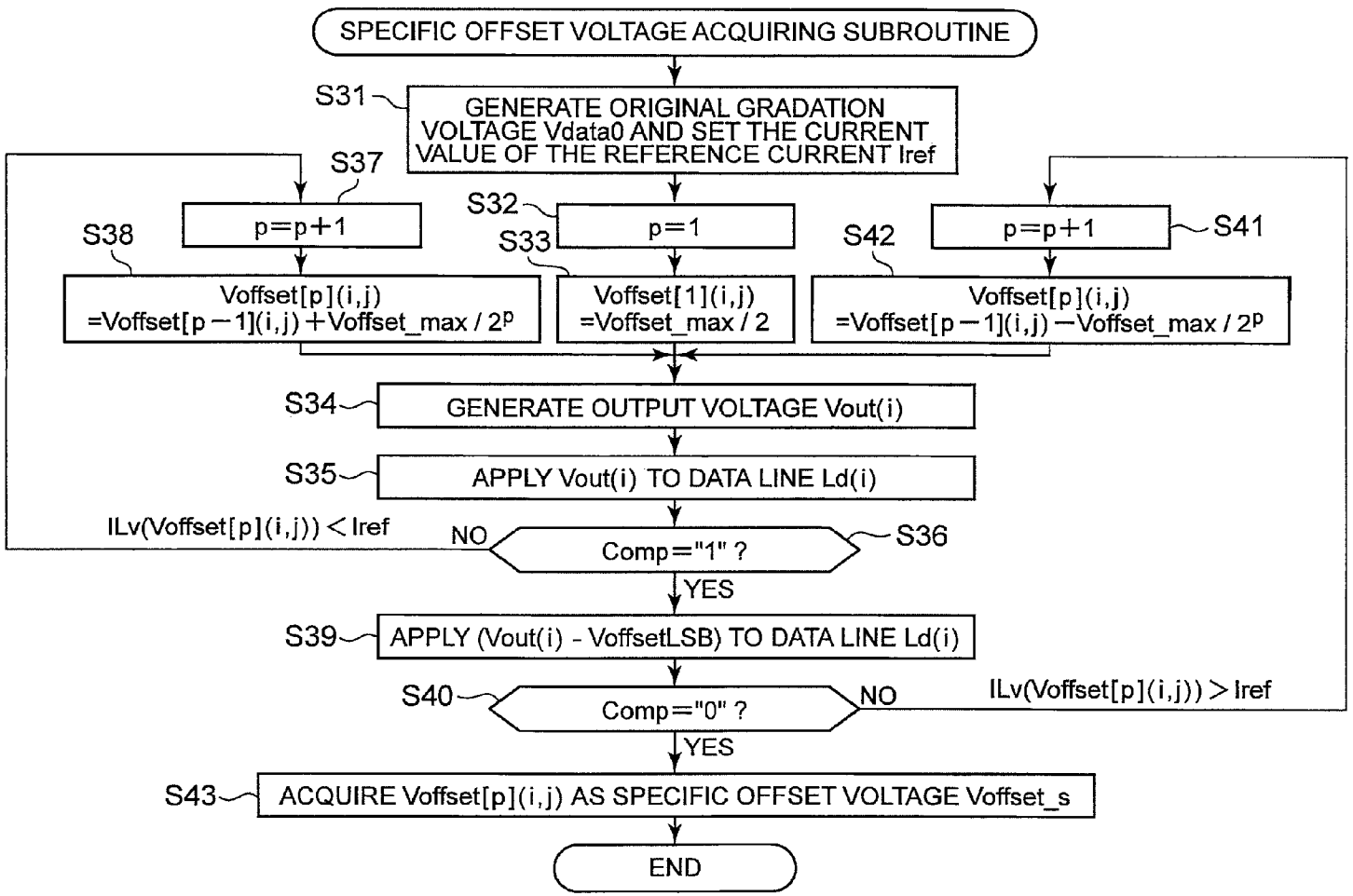
FIG. 9 is a flowchart of a specific offset voltage acquiring subroutine which is executed by the display device shown in FIG. 1.

The output circuit 34(*i*) executes a specific offset voltage acquiring subroutine for acquiring a specific offset voltage Voffset_s(i,j) according to the flowchart illustrated in FIG. 9 (step S16). The specific offset voltage acquiring subroutine will be discussed later.

The output circuit 34(*i*) stores a digital specific offset value Doffset_s(i,j) corresponding to the acquired specific offset voltage Voffset_s(i,j) into the frame memory 31 (step S17).

The display device 1 increments i (step S18) by 1, and determines whether or not i has exceeded m (step S19) where m is the number of columns of the TFT-OLED panel 11.

When i has not exceeded m (step S19; No), the display device 1 executes steps S14 to S18 again.

When i has exceeded m (step S19; Yes), the display device 1 increments j by 1 (step S20) and determines whether or not j has exceeded n (step S21) where n is the number of rows of the TFT-OLED panel 11.

When j has not exceeded n (step S21; No), the display device 1 repeatedly executes steps S12 to S20, as shown in FIGS. 7 and 8.

When j has exceeded n (step S21; Yes), the display device 1 terminates the specific offset voltage acquiring process.

(Specific Offset Voltage Acquiring Subroutine)

Next, the operation in the specific offset voltage acquiring subroutine will be described.

FIG. 9 is the flowchart of the specific offset voltage acquiring subroutine which is executed by the display device 1.

In the specific offset voltage acquiring subroutine, first, the gradation voltage generating circuit 41(*i*) of the output circuit 34(*i*) of the display device 1 generates the original gradation voltage Vdata0(*i*). The original gradation voltage Vdata0(*i*) may be generated, for example, in accordance with the digital data Din(i) supplied from the data latch circuit 33, or may be generated in accordance with digital data prestored in the gradation voltage generating circuit 41(*i*). The current comparison circuit 20(*j*) sets the current value of the reference current Iref to a value corresponding to the generated original gradation voltage Vdata0(*i*) (step S31).

Next, the offset voltage generating circuit 42(*i*) of the output circuit 34(*i*) sets "1" to the count value p for binary search (step S32).

The offset voltage generating circuit 42(*i*) sets the initial value Voffset[1](*i,j*) of the offset voltage to a value which is the maximum value Voffset_max of the offset voltage Voffset (i,j) divided by two (step S33). The maximum value Voffset_max of the offset voltage Voffset(i,j) is prestored in the offset voltage generating circuit 42(*i*), for example. The configuration may be modified so that the value of the maximum value Voffset_max is supplied from the controller 13.

Next, the voltage controlling circuit 43(*i*) generates the output voltage Vout(i) based on the set offset voltage Voffset [1](*i,j*) according to the equation 12 (step S34).

Then, the output circuit 34(*i*) applies the generated output voltage Vout(i) to the data line Ld(i) (step S35).

The offset voltage generating circuit 42(*i*) determines whether or not the comparison result Comp output from the comparator 23(*j*) of the current comparison circuit 20(*j*) is "1" (step S36).

When the comparison result Comp is not "1" but "0" (step S36; No), the offset voltage generating circuit 42(*i*) judges that the current value of the power supply current ILv is smaller than the current value of the reference current Iref, and increments the count value p by 1 (step S37).

The offset voltage generating circuit 42(*i*) generates the offset voltage Voffset[p](i,j) according to the equation 13 (step S38).

Next, the voltage controlling circuit 43(*i*) generates the output voltage Vout(i) based on the generated offset voltage Voffset[p] according to the equation 12 (step S34).

Then, the output circuit 34(*i*) applies the generated output voltage Vout(i) to the data line Ld(i) (step S35).

The offset voltage generating circuit 42(*i*) determines again whether or not the comparison result Comp output from the comparator 23(*j*) of the current comparison circuit 20(*j*) is "1" (step S36).

When the comparison result Comp is "1" (step S36; Yes), the offset voltage generating circuit 42(*i*) judges that the current value of the power supply current ILv is equal to or greater than the current value of the reference current Iref. Then, the voltage controlling circuit 43(*i*) generates a voltage (Vdata0(*i*)+Voffset[p](i,j)−VoffsetLSB=Vout(i)−VoffsetLSB) as the output voltage Vout(i). Then, the output circuit 34(*i*) applies this output voltage Vout(i) to the data line Ld(i) (step S39).

Next, the offset voltage generating circuit 42(*i*) determines whether or not the comparison result Comp output from the comparator 23(*j*) of the current comparison circuit 20(*j*) is "0" (step S40).

When the comparison result Comp is not "0" but "1" (step S40; No), the voltage controlling circuit 43(*i*) judges that the current value of the power supply current ILv is greater than the current value of the reference current Iref, and increments the count value p by 1 (step S41).

The offset voltage generating circuit 42(*i*) generates the offset voltage Voffset[p](i,j) according to the equation 14 (step S42).

Next, the voltage controlling circuit 43(*i*) generates the output voltage Vout(i) according to the equation 12 (step S34).

Then, the output circuit 34(*i*) applies the generated output voltage Vout(i) to the data line Ld(i) (step S35).

The offset voltage generating circuit 42(*i*) determines again whether or not the comparison result Comp output from the comparator 23(*j*) of the current comparison circuit 20(*j*) is "1" (step S36).

When the comparison result Comp is "1" (step S36; Yes), the voltage controlling circuit 43(*i*) generates a voltage (Vdata0(*i*)+Voffset[p](i,j)−VoffsetLSB) as the output voltage Vout(i). Then, the output circuit 34(*i*) applies this output voltage Vout(i) to the data line Ld(i) (step S39).

When the comparison result Comp becomes "0" (step S40; Yes), considering that the condition 11 is fulfilled, the offset voltage generating circuit 42(*i*) acquires the then offset voltage Voffset[p](i,j) as the specific offset voltage Voffset_s(i,j) (step S43). Then, the subroutine is terminated too return to the specific offset voltage acquiring process.

Next, a specific description of the specific offset voltage acquiring process will be given of the case where i=1 and j=1.

Figure 10:
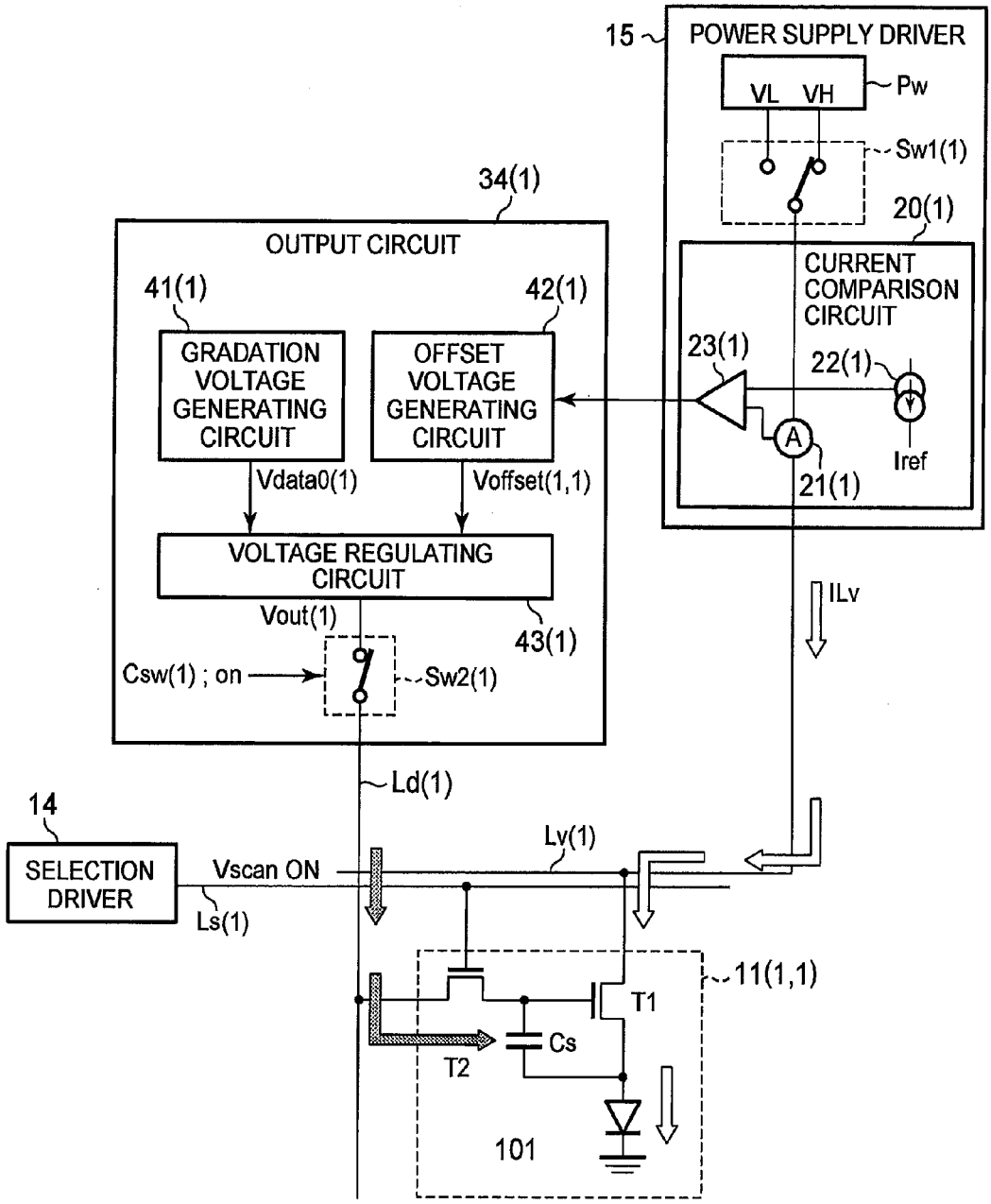
FIG. 10 is a diagram illustrating a specific operation of the specific offset voltage acquiring process which is executed by the display device shown in FIG. 1.
Figure 11:
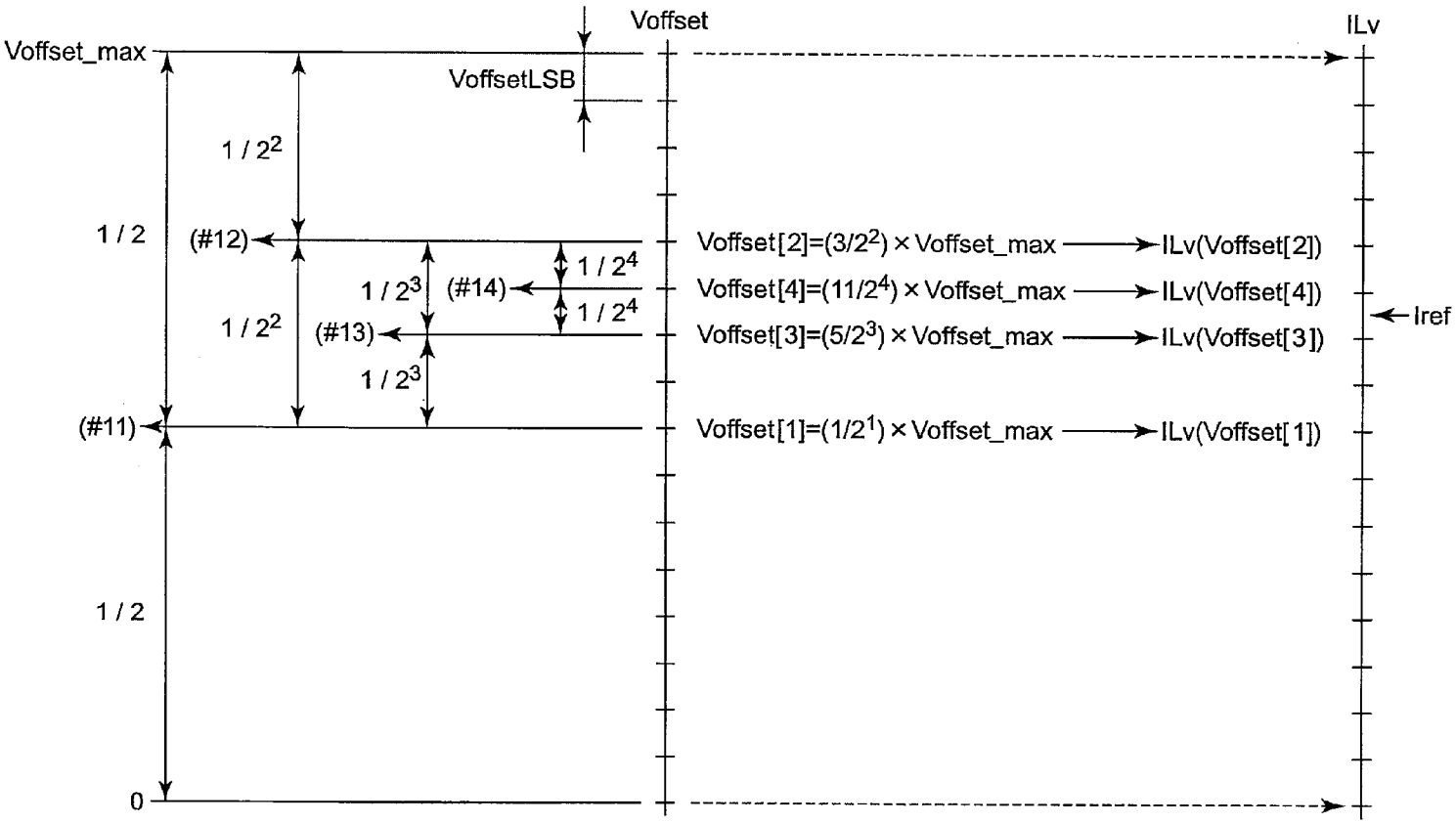
FIG. 11 is a diagram showing a specific example of an offset voltage generated in the specific offset voltage acquiring process which is executed by the display device shown in FIG. 1.

FIG. 10 is a diagram illustrating a specific operation of the specific offset voltage acquiring process which is executed by the display device 1, and FIG. 11 is a diagram showing a specific example of an offset voltage generated in the specific offset voltage acquiring process.

When the selection driver 14 executes step S13 in FIG. 7, as shown in FIG. 10, the transistor T2 of each of the pixels 11(1,1) to 11(*m*,1) is turned on in response to the select signal Vscan(1) with the Vscan ON level supplied to the gate thereof.

Further, the transistor T1 of each of the pixels 11(1,2) to 11(*m*,2) of the second row to the pixels 11(1,*n*) to 11(*m,n*) of the nth row is turned off in response to the scan line signal Vscan(not j) with the Vscan OFF level supplied to the gate thereof.

When the controller 13 executes step S14, as shown in FIG. 10, the output switch Sw2(1) is closed in response to the ON-level switch control signal Csw(1) supplied from the controller 13, thereby connecting the voltage controlling circuit 43(1) to the data line Ld(1).

When the voltage controlling circuit 43(1) is connected to the data line Ld(1), the output voltage Vout(1) is applied to the data line Ld(1) from the output circuit 34(1). As a result, as indicated by arrows in FIG. 10, the output voltage Vout(1) is applied to the gate of the transistor T1 from the output circuit 34(1) via the data line Ld(1) and the transistor T2 of the pixel 11(1,1).

When the controller 13 executes step S14, as shown in FIG. 10, The output switches Sw2(2) to Sw2(*n*) are opened in response to the OFF-level switch control signals Csw(2) to Csw(n) supplied from the controller 13, thereby disconnecting the voltage controlling circuits 43(2) to 43(*n*) from the data lines Ld(2) to Ld(n), respectively. As a result, the output voltages Vout(2) to Vout(m) are not applied to the pixels 11(2,1) to 11(*m*,1).

When the power supply driver 15 changes over the switch Sw1(1) to the voltage VH side, the power supply current ILv flows to the ground potential side through the power supply line Lv(1), the between the drain and source of the transistor T1, and the organic EL device 101 as indicated by arrows in FIG. 10.

In case where the maximum value Voffset_max of the offset voltage Voffset, the voltage (value) VoffsetLSB corresponding to the least significant bit of the offset voltage Voffset, and the reference current Iref are set and as shown in FIG. 11, when the offset voltage generating circuit 42(1) executes step S33 in FIG. 9 with p=1, the offset voltage Voffset[1](1,1)=(1/2)×Voffset_max (#11 in FIG. 11). FIG. 11 shows a case where the offset value Doffset(i,j) has four bits.

Next, when the output circuit 34(1) executes steps S35 and S36, ILv(Voffset[1](1,1)<Iref, so that the comparator 23(1) supplies the comparison result Comp="0" to the data driver 16.

When Comp="0" (step S36; No), the offset voltage generating circuit 42(1) executes steps S37 and S38, so that the offset voltage Voffset[2](1,1) becomes $(3/2^2)\times$Voffset_max (#12 in FIG. 11) as shown by the following equation 15.

$$\begin{aligned} Voffset[2](1,1) &= Voffset[1](1,1) + (1/2^2)\times \text{Voffset_max} \\ &= (1/2)\times \text{Voffset_max} + (1/2^2)\times \text{Voffset_max} \\ &= (3/2^2)\times \text{Voffset_max} \\ &= (3/4)\times \text{Voffset_max} \end{aligned} \tag{15}$$

Next, when the output circuit 34(1) executes steps S35 and S36, ILv(Voffset[1](1,1))>Iref, so that the comparator 23(1) supplies the comparison result Comp="1" to the data driver 16.

When Comp="1" (step S36; Yes), the output circuit 34(1) executes steps S39 and S40. In this case, ILv(Voffset[2](1,1)−VoffsetLSB)>Iref, so that comparator 23(1) supplies the comparison result Comp="1" to the data driver 16.

When Comp="1" (step S40; No), the offset voltage generating circuit 42(1) judges that the offset voltage Voffset[2](1,1) does not fulfill the condition 11, and executes steps S41 and S42. When steps S41 and S42 are executed, the offset voltage Voffset[3] becomes $(5/2^3)\times$Voffset_max (#13 in FIG. 11) as shown by the following equation 16.

$$\begin{aligned} Voffset[3](1,1) &= Voffset[2](1,1) - (1/2^3)\times \text{Voffset_max} \\ &= (3/2^2)\times \text{Voffset_max} - (1/2^3)\times \text{Voffset_max} \\ &= (5/2^3)\times \text{Voffset_max} \\ &= (5/8)\times \text{Voffset_max} \end{aligned} \tag{16}$$

Next, when the output circuit 34(1) executes steps S35 and S36, ILv(Voffset[1](1,1))<Iref, so that the comparator 23(1) supplies the comparison result Comp="0" to the data driver 16.

When Comp="0" (step S36; No), the offset voltage generating circuit 42(1) executes steps S37 and S38, so that the offset voltage Voffset[4](1,1) becomes $(11/2^4)\times$Voffset_max (#14 in FIG. 11) as shown by the following equation 17.

$$\begin{aligned} Voffset[4](1,1) &= Voffset[3](1,1) + (1/2^4)\times \text{Voffset_max} \\ &= (5/2^3)\times \text{Voffset_max} + (1/2^4)\times \text{Voffset_max} \\ &= (11/2^4)\times \text{Voffset_max} \\ &= (11/16)\times \text{Voffset_max} \end{aligned} \tag{17}$$

Next, when the output circuit 34(1) executes steps S35 and S36, ILv(Voffset[1](1,1))>Iref, so that the comparator 23(1) supplies the comparison result Comp="1" to the data driver 16.

When Comp="1" (step S36; Yes), the output circuit 34(1) executes steps S39 and S40. In this case, ILv(Voffset[2](1,1)−VoffsetLSB)<Iref, so that comparator 23(1) supplies the comparison result Comp="0" to the data driver 16.

When Comp="0" (step S40; Yes), the offset voltage generating circuit 42(1) judges that the offset voltage Voffset[4](1,1) fulfills the condition 11, and decides the offset voltage Voffset[4](1,1) as the specific offset voltage Voffset_s(1,1) corresponding to a change in the threshold voltage Vth.

In the case of this specific example, the specific offset voltage Voffset_s(1,1) corresponding to a change in the threshold voltage Vth can be decided by performing four searches using binary search.

According to the embodiment, as described above, the display device 1 acquires the specific offset voltage Voffset_s corresponding to a change in the threshold voltage Vth using binary search.

As compared with the related art system which sequentially changes, for example, the offset voltage Voffset for a given unit voltage, therefore, the resolution can be made relatively lower while making the variable range of the offset voltage Voffset relatively wider, and the specific offset voltage Voffset_s can be acquired in a relatively short period of time.

The number of comparisons should correspond to the number of bits of the offset value Doffset(i,j); for example, if the offset value Doffset(i,j) has eight bits, the specific offset voltage Voffset_s can be acquired in eight comparisons at a maximum. Accordingly, the time required to acquire the specific offset voltage Voffset_s is made shorter than that of the related art system, making it possible to perform, for example, acquisition of the specific offset voltage relatively frequently. This makes it possible to keep the display quality of the display device 1 well.

The foregoing embodiment of the invention is not restrictive, and various modes are feasible in carrying out the invention.

For example, each output circuit 34(*i*) has an output switch Sw2(*i*) in the embodiment. Instead of having the output switch Sw2(*i*), however, the data driver 16 may output a signal of a potential which is sufficiently lower than a supply voltage Vdd and makes the resistance of the transistor T1 sufficiently high, so that the current leak from other data lines Ld(not i) does not occur.

The output circuit 34(1) may perform the equations 13 and 14 until the following condition 12, instead of the condition 11, is fulfilled, and sets the offset voltage Voffset which fulfills the condition 12 as the specific offset voltage Voffset_s corresponding to a change in the threshold voltage Vth. That is, when the power supply current ILv when the offset voltage is Voffset[p] is smaller than the reference current Iref, and when the power supply current ILv when the offset voltage is increased by one bit which is the minimum resolution of Voffset[p] is greater than the reference current Iref, the offset voltage Voffset[p] is acquired as the specific offset voltage Voffset_s.

$$ILv(Voffset[p]) \leqq Iref \quad \text{and} \quad ILv(Voffset[p]) + Voffset\,LSB) \geqq Iref \qquad \text{<Condition 12>}$$

Figure 12:
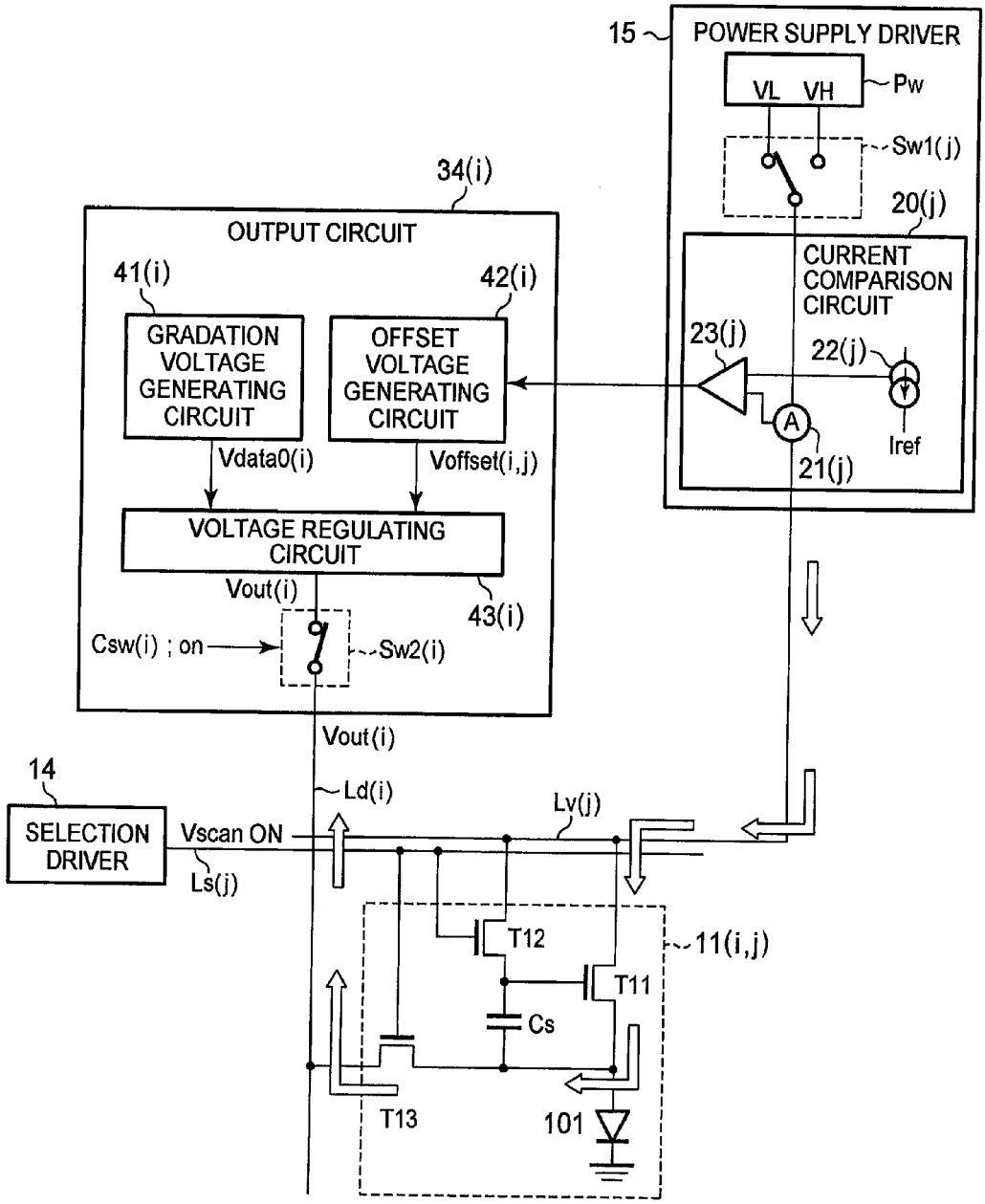
FIG. 12 is a diagram showing a structure for acquiring a specific offset voltage when a pixel has another structure.
Figure 13:
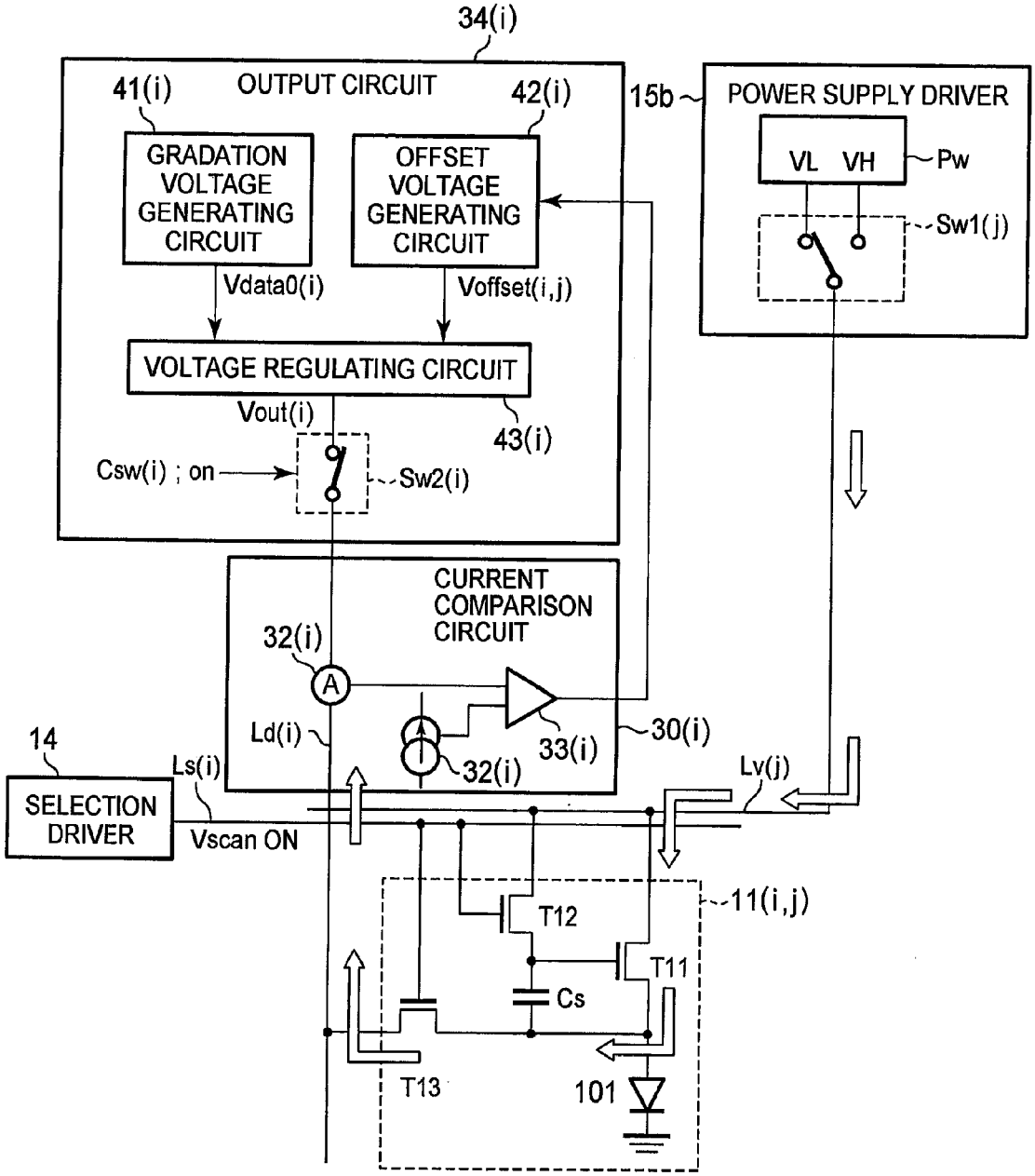
FIG. 13 is a diagram showing another structure for acquiring a specific offset voltage when a pixel has a further structure.

The pixel 11(*i*,*j*) has been described as having the structure shown in FIG. 2 in the foregoing embodiment. However, this structure of the pixel 11(*i*,*j*) is not restrictive. The pixel 11(*i*,*j*) may have, for example, a structure shown in FIG. 12. FIG. 12 is a diagram showing a structure for acquiring a specific offset voltage when a pixel has another structure different from the one shown in FIG. 2. FIG. 13 is a diagram showing another structure adaptable to acquire a specific offset voltage when a pixel has the structure shown in FIG. 12. Each pixel 11(*i*,*j*) shown in FIG. 12 has an organic EL device 101, transistors T11 to T13, and a capacitor Cs.

In case of the pixel 11(*i*,*j*) shown in FIG. 12 whose structure differs from that of FIG. 2, the output voltage Vout(i) generated by the output circuit 34(*i*) is set to a negative voltage. Then, when the power supply driver 15 applies a Low-level voltage VL to the power supply line Lv(j), and the select signal Vscan(i) with the Vscan ON level is supplied to the scan line Ls(j), the transistors T12, T13 are turned on, connecting the gate and drain of the transistor T11 via the transistor T12. The connection of the gate and drain of the transistor T11 together provides the diode connection. Then, as indicated by arrows in FIG. 12, the current corresponding to the output voltage Vout(i) flows from the power supply line Lv(j) in the direction of pulling the current toward the output circuit 34(*i*) via the transistors T11, T13 of the pixel 11(*i*,*j*) and the data line Ld(i). Accordingly, a charge corresponding to the output voltage Vout(i) can be written in the capacitor Cs. At this time, a reverse bias is applied between the anode and cathode of the organic EL device 101, preventing the current from flowing therethrough, so that the organic EL device 101 does not emit light.

Even when the pixel 11(*i*,*j*) has the structure shown in FIG. 12, the power supply driver 15 can take the same structure as used in the embodiment. In addition, as the system for acquiring a specific offset voltage according to variation of the characteristic of the transistor T1 of each pixel 11(*i*,*j*), the same system as used in the embodiment can be employed. That is, it is possible to use the system of applying the output voltage Vout(i) to the data line Ld(i) while varying the offset voltage Voffset(i,j), and comparing the power supply current ILv flowing through the power supply line Lv(j) with the reference current Iref to acquire a specific offset voltage Voffset_s(i,j) corresponding to a change in the threshold voltage Vth of the transistor T1. In this case, since the current flows through the data line Ld(i) in the direction of pulling the current toward the output circuit 34(*i*), the offset voltage Voffset(i,j) is set to a negative polarity.

Although the power supply driver 15 has the current comparison circuit 20(*j*) as shown in FIG. 3 according to the foregoing embodiment, this configuration is not restrictive. Since, when the pixel 11(*i*,*j*) has the structure shown in FIG. 12, for example, the current corresponding to the output voltage Vout(i) flows from the power supply line Lv(j) toward the output circuit 34(*i*) via the transistors T11, T13 of the pixel 11(*i*,*j*) and the data line Ld(i), the structure as shown in FIG. 13 may be employed. According to the structure, a plurality of current comparison circuits 30(*i*) are provided in association with each data line Ld(i). The current comparison circuits 30(*i*) are provided in, for example, the data driver 16.

In this example, each current comparison circuit 30(*i*), like the current comparison circuit 20(*j*), has a ammeter 31(*i*), a constant current source 32(*i*) which supplies a reference current Iref, and a comparator 33(*i*). The current comparison circuits 30(*i*) compare the current flowing through the data line Ld(i) with the reference current Iref. A power supply driver 15*b* has a power supply circuit Pw which outputs a voltage VH and voltage VL, and switches Sw1(*j*) provided in association with the respective power supply lines Lv(j).

The structure shown in FIG. 13 can also employ the same system as used in the foregoing embodiment as the system of acquiring a specific offset voltage according to variation of the characteristic of the transistor T1 of each pixel 11(*i*,*j*). That is, it is possible to use the system of applying the output voltage Vout(i) to the data line Ld(i) while varying the offset voltage Voffset(i,j), and comparing the power supply current ILv flowing through the data line Ld(i) with the reference current Iref to acquire a specific offset voltage Voffset_s(i,j) corresponding to a change in the threshold voltage Vth of the transistor T1.

Although the description of the embodiment has been given of the case where the light emitting apparatus according to the invention is applied to the display device 1 which has the TFT-OLED panel 11, the invention is not limited to this case. For example, the invention may be adapted to an exposure apparatus that has a light emitting device array having a plurality of pixels each having a light emitting device arranged in one direction, and irradiates a photosensitive drum with light output from the light emitting device array according to image data to thereby expose the photosensitive drum. In this case, the specific offset voltage Voffset can be acquired in a short period of time, making it possible to keep the exposure state well.

Having described and illustrated the principles of this application by reference to one or more preferred embodiments, it should be apparent that the preferred embodiments may be modified in arrangement and detail without departing from the principles disclosed herein and that it is intended that the application be construed as including all such modifications and variations insofar as they come within the spirit and scope of the subject matter disclosed herein.

What is claimed is:

1. A pixel drive apparatus for driving pixels each having a light emitting device and a drive transistor whose current path has a first end connected to the light emitting device, the apparatus comprising:

a power supply configured to be connectable to a second end of the current path of the drive transistor and to output a supply voltage;

an offset voltage generating circuit that generates an offset voltage;

a voltage controlling circuit that generates an output voltage which is a predetermined gradation voltage added with the offset voltage; and a current comparison circuit that compares a current value of a reference current corresponding to the gradation voltage with a current value of current flowing in the current path of the drive transistor when the supply voltage is applied to the second end of the current path of the drive transistor and a voltage based on the output voltage is applied to a control terminal of the drive transistor;

wherein the offset voltage generating circuit sets a voltage value of the offset voltage through binary search based on a voltage value of an initial voltage, and acquires a specific offset voltage corresponding to a variation of a characteristic of the drive transistor based on a result of comparison performed by the current comparison circuit according to the offset voltage; and wherein the offset voltage generating circuit:

generates the offset voltage based on a digital value of a predetermined number of bits;

generates, as the digital value, a first value set through the binary search, and a second value obtained by increasing or decreasing one bit from the first value;

repetitively performs re-setting of the voltage value of the offset voltage to a value changed through the binary search, and the comparison in the current comparison circuit according to the set offset voltage, until the current value of the reference current is judged to lie in a range of current values of two currents flowing in the current path of the drive transistor according to two offset voltages corresponding to the first value and the second value; and acquires the offset voltage corresponding to the first value as the specific offset voltage when the current value of the reference current is judged to lie in the range.

2. The pixel drive apparatus according to claim 1, wherein the current value of the reference current is set to a current value of a current flowing in the current path of the drive transistor when the drive transistor has an initial characteristic and a voltage based on the gradation voltage is applied to the control terminal of the drive transistor.

3. The pixel drive apparatus according to claim 1, further including a gradation voltage generating circuit that generates and supplies the gradation voltage to the voltage controlling circuit.

4. The pixel drive apparatus according to claim 3, further including a storage circuit that stores a specific offset value corresponding to the specific offset voltage acquired by the offset voltage generating circuit.

5. The pixel drive apparatus according to claim 4, wherein the gradation voltage generating circuit generates the gradation voltage based on a display signal supplied externally, the offset voltage generating circuit generates a specific offset voltage based on the specific offset value stored in the storage circuit, and the voltage controlling circuit generates the output voltage which is the gradation voltage added with the offset voltage.

6. The pixel drive apparatus according to claim 1, wherein the current comparison circuit is provided between an output terminal of the power supply and the second end of the current path of the drive transistor.

7. The pixel drive apparatus according to claim 1, wherein the current comparison circuit is provided between an output terminal of the voltage controlling circuit and the first end of the current path of the drive transistor.

8. A light emitting apparatus comprising:

at least one pixel having a light emitting device and a drive transistor whose current path has a first end connected to the light emitting device;

at least one signal line connected to the pixel;

a power supply configured to be connectable to a second end of the current path of the drive transistor and output a supply voltage;

at least one offset voltage generating circuit provided in association with the signal line to generate an offset voltage;

at least one voltage controlling circuit provided in association with the signal line to generate an output voltage which is a predetermined gradation voltage added with the offset voltage; and at least one current comparison circuit that compares a current value of a reference current corresponding to the gradation voltage with a current value of current flowing in the current path of the drive transistor when the supply voltage is applied to the second end of the current path of the drive transistor and a voltage based on the output voltage generated is applied to a control terminal of the drive transistor;

wherein the offset voltage generating circuit sets a voltage value of the offset voltage through a binary search based on a voltage value of an initial voltage, and acquires a specific offset voltage corresponding to a variation of a characteristic of the drive transistor based on a result of a comparison performed by the current comparison circuit according to the offset voltage; and wherein the offset voltage generating circuit:

generates the offset voltage based on a digital value of a predetermined number of bits;

generates, as the digital value, a first value set through the binary search, and a second value obtained by increasing or decreasing one bit from the first value;

repetitively performs re-setting of the voltage value of the offset voltage to a value changed through the binary search, and the comparison in the current comparison circuit according to the set offset voltage, until the current value of the reference current is judged to lie in a range of current values of two currents flowing in the current path of the drive transistor according to two offset voltages corresponding to the first value and the second value; and acquires the offset voltage corresponding to the first value as the specific offset voltage when the current value of the reference current is judged to lie in the range.

9. The light emitting apparatus according to claim 8, wherein the current value of the reference current is set to a current value of a current flowing in the current path of the drive transistor when the drive transistor has an initial characteristic and a voltage based on the gradation voltage is applied to the control terminal of the drive transistor.

10. The light emitting apparatus according to claim 8, further including at least one gradation voltage generating circuit provided in association with the signal line to generate and supply the gradation voltage to the voltage controlling circuit.

11. The light emitting apparatus according to claim 10, further including a storage circuit that stores a specific offset value corresponding to the specific offset voltage acquired by the offset voltage generating circuit.

12. The light emitting apparatus according to claim 11, wherein the gradation voltage generating circuit generates the gradation voltage based on a display signal supplied externally, the offset voltage generating circuit generates a specific offset voltage based on the specific offset value stored in the storage circuit, and the voltage controlling circuit generates the output voltage which is the gradation voltage added with the offset voltage.

13. The light emitting apparatus according to claim 8, wherein the current comparison circuit is provided between an output terminal of the power supply and one end of a power supply line connected to the second end of the current path of the drive transistor.

14. The light emitting apparatus according to claim 8, wherein a first end of the signal line is electrically connected to the first end of the current path of the drive transistor, and the current comparison circuit is provided between an output terminal of the voltage controlling circuit and a second end of the signal line.

15. The light emitting apparatus according to claim 8, wherein the light emitting device comprises an organic electroluminescent device.

16. A drive control method for a light emitting apparatus including at least one pixel having a light emitting device and a drive transistor whose current path has a first end connected to the light emitting device, and at least one signal line connected to the pixel, the method comprising:

generating a predetermined gradation voltage;

generating an offset voltage;

generating an output voltage which is the gradation voltage added with the offset voltage;

applying a voltage based on the output voltage to a control terminal of the drive transistor via the signal line;

comparing a current value of a reference current corresponding to the gradation voltage with a current value of the current flowing in the current path of the drive transistor when a supply voltage is applied to a second end of the current path of the drive transistor and the voltage based on the output voltage is applied to the control terminal of the drive transistor; and acquiring a specific offset voltage corresponding to a variation of a characteristic of the drive transistor based on a result of the comparing;

wherein generating the offset voltage comprises setting a voltage value of the offset voltage through a binary search based on a voltage value of an initial voltage, and the specific offset voltage is acquired based on the result of the comparing according to the set offset voltage wherein the offset voltage is generated based on a digital value of a predetermined number of bits; and wherein acquiring the specific offset voltage comprises:

generating, as the digital value, a first value set through the binary search, and a second value obtained by increasing or decreasing one bit from the first value;

judging whether or not the current value of the reference current lies in a range of current values of two currents flowing in the current path of the drive transistor according to two offset voltages corresponding to the first value and the second value, based on a result of the comparing;

repeating re-setting of the voltage value of the offset voltage to a value changed through the binary search, and the judging according to the set offset voltage, until the current value of the reference current is judged by the judging to lie in the range; and acquiring the offset voltage corresponding to the first value as the specific offset voltage when the current value of the reference current is judged by the judging to lie in the range.

* * * * *